US009021649B2

(12) United States Patent
Minkler et al.

(10) Patent No.: US 9,021,649 B2
(45) **Date of Patent: *May 5, 2015**

(54) CLEANING TOOL ASSEMBLY WITH A DISPOSABLE CLEANING IMPLEMENT

(71) Applicant: The Clorox Company, Oakland, CA (US)

(72) Inventors: Douglas J. Minkler, Pleasanton, CA (US); Russell E. Bell, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/622,283

(22) Filed: Sep. 18, 2012

(65) Prior Publication Data

US 2013/0014337 A1 Jan. 17, 2013

Related U.S. Application Data

(60) Division of application No. 12/554,242, filed on Sep. 4, 2009, now Pat. No. 8,286,295, which is a continuation of application No. 11/738,133, filed on Apr. 20, 2007, now Pat. No. 7,603,739, which is a continuation of application No. 10/678,033, filed on Sep. 30, 2003, now Pat. No. 7,386,910.

(51) Int. Cl.
*A47L 13/16* (2006.01)
*A47K 11/10* (2006.01)

(52) U.S. Cl.
CPC *A47K 11/10* (2013.01); *A47L 13/16* (2013.01)

(58) Field of Classification Search
USPC ..... 15/145, 210.1, 244.1, 229.13, 176.1, 15/176.6, 176.5, 209.1, 143.1, 1, 60, 15/244.2, 164, 244.3, 245.1, 211; 294/100
See application file for complete search history.

(56) References Cited

U.S. PATENT DOCUMENTS 2,428,306 A 9/1947 Beagle
2,752,625 A * 7/1956 Athalia Ponsell ..... 15/229.13

(Continued)

FOREIGN PATENT DOCUMENTS

EP 0 313 495 10/1988
EP 1 254 950 11/2000

(Continued)

*Primary Examiner* — Gary Graham
(74) *Attorney, Agent, or Firm* — Erin Collins

(57) ABSTRACT

A cleaning assembly including a disposable cleaning implement having a cleaning element mounted to a fitment having an elongated post. The cleaning assembly includes an elongated maneuvering wand having a handle portion and a distal implement attachment end thereof. A gripping mechanism is coupled to the wand attachment end, and is configured to releasably grip the fitment post to mount the cleaning implement. The gripping mechanism and the maneuvering wand cooperate to substantially limited pivotal movement of a longitudinal axis of the fitment post, relative a longitudinal axis of the gripping mechanism to not more than about 0 degrees to about 25 degrees when the fitment post is subjected to forces radial to the longitudinal axis of the fitment post. In another aspect, the frictional drag between the sliding components is significantly reduced, enabling a tool assembly with a high axial holding force for the cleaning implement, but with a significantly lower, consumer friendly release force for the Implement during release operation of the tool assembly.

10 Claims, 13 Drawing Sheets

(56) References Cited

U.S. PATENT DOCUMENTS

| | | | | |
|---|---|---|---|---|
| 3,256,075 | A * | 6/1966 | Robert et al. | 51/295 |
| 4,457,038 | A | 7/1984 | Hammond | |
| 4,466,152 | A | 8/1984 | Moss et al. | |
| 4,493,124 | A | 1/1985 | Agapion | |
| 4,642,836 | A | 2/1987 | Bokmiller | |
| 4,663,796 | A | 5/1987 | Helling et al. | |
| 4,852,201 | A | 8/1989 | Wundrock et al. | |
| 4,987,634 | A * | 1/1991 | Weihrauch | 15/209.1 |
| 5,381,809 | A | 1/1995 | Parker, Jr. | |
| 5,407,594 | A | 4/1995 | Fry et al. | |
| 5,471,697 | A | 12/1995 | Daconta | |
| 5,630,243 | A | 5/1997 | Federico et al. | |
| 5,658,874 | A | 8/1997 | Davies et al. | |
| 5,842,810 | A | 12/1998 | Morad | |
| 5,862,565 | A | 1/1999 | Lundstedt | |
| 5,888,002 | A | 3/1999 | Fenstersheib | |
| 5,941,379 | A | 8/1999 | Barardo | |
| 5,945,076 | A | 8/1999 | Leonard et al. | |
| D413,470 | S | 9/1999 | Burton | |
| 6,094,771 | A | 8/2000 | Egolf et al. | |
| 6,154,913 | A | 12/2000 | Burton | |
| 6,191,100 | B1 | 2/2001 | Askew et al. | |
| RE37,190 | E | 5/2001 | Stowell et al. | |
| 6,295,688 | B1 | 10/2001 | Sayles | |
| 6,313,086 | B1 | 11/2001 | Askew et al. | |
| 6,355,607 | B1 | 3/2002 | Rahman et al. | |
| 6,405,403 | B1 | 6/2002 | McKay | |
| 6,413,928 | B1 | 7/2002 | Painter et al. | |
| 6,426,111 | B1 | 7/2002 | Hirsch | |
| 6,523,213 | B1 | 2/2003 | Post | |
| 6,611,986 | B1 * | 9/2003 | Seals | 15/210.1 |
| D501,728 | S | 2/2005 | Conway et al. | |
| D502,002 | S | 2/2005 | Conway et al. | |
| D502,324 | S | 3/2005 | Conway et al. | |
| 6,978,508 | B2 | 12/2005 | Young | |
| 7,059,008 | B2 | 6/2006 | Morgan et al. | |
| D532,564 | S | 11/2006 | Neumann et al. | |
| 7,159,265 | B2 | 1/2007 | Soller et al. | |
| 7,316,046 | B2 | 1/2008 | Michaels et al. | |
| 7,386,910 | B2 * | 6/2008 | Minkler et al. | 15/210.1 |
| 2002/0007527 | A1 | 1/2002 | Hart | |
| 2002/0032137 | A1 | 3/2002 | DeSenna et al. | |
| 2002/0061831 | A1 | 5/2002 | Kaziska et al. | |
| 2002/0083542 | A1 | 7/2002 | Hart | |
| 2002/0173442 | A1 | 11/2002 | Smith et al. | |
| 2005/0005378 | A1 | 1/2005 | Soler et al. | |
| 2007/0006412 | A1 | 1/2007 | Soller et al. | |

FOREIGN PATENT DOCUMENTS

| | | |
|---|---|---|
| JP | 09-135728 | 5/1997 |
| JP | 1025610 A2 | 11/1998 |
| WO | WO 87/00411 | 1/1987 |
| WO | WO 00/34422 | 6/2000 |
| WO | WO 00/71012 | 11/2000 |
| WO | WO 01/15587 | 3/2001 |
| WO | WO 01/26499 | 4/2001 |
| WO | WO 01/30954 | 5/2001 |
| WO | WO 01/43618 | 6/2001 |
| WO | WO 01/49818 | 7/2001 |
| WO | WO2005006933 | 1/2005 |

* cited by examiner

CLEANING TOOL ASSEMBLY WITH A DISPOSABLE CLEANING IMPLEMENT

CROSS-REFERENCES TO RELATED APPLICATIONS

This application is a divisional application and claims priority to U.S. application Ser. No. 12/554,242, filed on Sep. 4, 2009, now U.S. Pat. No. 8,286,295; which is a continuation of U.S. application Ser. No.11/738,133, filed on Apr. 20, 2007, now U.S. Pat. No. 7,603,739; which is a continuation of application of U.S. application Ser. No. 10/678,033 filed on Sep. 30, 2003, now U.S. Pat. No. 7,386,910, which is hereby incorporated by reference.

FIELD OF THE INVENTION

The present invention relates to cleaning tools, and more particularly, relates to toiletry cleaning tools adapted to grip and maneuver disposable cleaning implements.

BACKGROUND OF THE INVENTION

Due to heath and sanitation concerns, lavatory facilities, such as toilets and urinals, are routinely cleaned. Such cleansing not only precludes the spread of infections and disease in commercial and public establishment, but also prevents or reduces unpleasant odors in residential facilities. The routine application of deodorizers and disinfectants aim to maintain a fresh and substantially germ-free environment.

Typically, special toilet bowl brushes and cleaning solutions are applied to all surfaces of the toilet to perform effective cleansing. Generally, these cleaning devices include an elongated handle with a brush head or the like mounted to the distal end thereof. These head enable cleaning inside the bowl and drain without physically contacting the toilet. One particularly unpleasant task, however, involves the cleaning of underside of the lip and rim portion of the toilet bowl. To reduce tactile contact, and required entry into the bowl, toilet brushes are often angled at the brush head which aids reaching such undersides of the rim. Moreover, the containers for the disinfecting and deodorizing solutions are also often angled or have "duck neck" spoors to achieve delivery of the solutions to the undersides of the rim.

Regardless of what chemical process or solutions are applied, some amount of physical scrubbing contact with the brush-is necessary to effectively remove stains and deposits. Thus, after disinfecting and deodorizing solutions have been applied, the special toilet bowl brush is utilized to brush and scrub the bowl surfaces as mentioned. While this time tested technique is adequate to disinfect and clean the toilet facilities, several inherent problems with this arrangement exist. For example, once the bowl has been cleaned, the brush is typically rinsed or allowed to drip dry before storage or further use. Accordingly, any infectious germs which may have been collected on the tool are likely to remain in some part on the brush, and are likely to be transported along with the brush.

Moreover, this cleaning arrangement is potentially dangerous in that these toxic, liquid disinfectants and deodorizers pose serious heath hazards. Such cleansers, which are either acidic or caustic, are typically stored under the sink, and may be accessible to unknowing small children. In severe cases of scale removal, highly acidic concentrations of solution, containing hydrochloric or hydrofluoric acids, may be necessary. Such use requires additional safety gear such as protective gloves and protective eye-goggles.

Accordingly, there is need for a cleaning tool that reduces, if not eliminates, the transmission of infections germs and from one location to another, as well as reduces the potential health hazards associated with liquid disinfectants and deodorizers.

SUMMARY OF INVENTION

The present invention provides a cleaning assembly including a disposable cleaning implement having a cleaning element mounted to a fitment having an elongated post, and an elongated maneuvering wand having a handle portion and a distal implement attachment end thereof. A gripping mechanism is coupled to the wand attachment end, and is configured to releasably grip the fitment post to mount the cleaning implement. The gripping mechanism and the maneuvering wand cooperate to substantially limited pivotal movement of a longitudinal axis of the fitment post, relative a longitudinal axis of the gripping mechanism to not more than about 0 degrees to about 25 degrees when the fitment post is subjected to forces radial to the longitudinal axis of the fitment post.

In one aspect of the present invention, the cleaning assembly incorporates an anti-cam device that significantly limits the pivotal motion of the cleaning head fitment in the gripping mechanism, and hence, substantially prevent side ejection from me gripping mechanism. Accordingly, during operational use of the cleaning tool, significantly greater lateral forces can be applied to the cleaning implement during cleaning with a gripping mechanism that would not otherwise be capable of handling such forces. The design of the gripping mechanism, hence, can primarily concentrate on axial retention of the retaining barb.

In one specific embodiment, the pivotal movement of the longitudinal axis of the fitment post, relative the longitudinal axis of the gripping mechanism, is substantially limited to not more than shout 0 degrees to about twelve (12) degrees, and even more preferably about 0 degrees to about six (6) degrees.

The anti-cam out feature includes a distal annular rib portion having a first contact surface extending substantially circumferentially around a first portion of the fitment post when oriented in the gripping position. The first contact surface includes a transverse cross-sectional dimension substantially similar to a transverse cross-sectional dimension of the first portion of the fitment post such that a tolerance therebetween in the range of about 0.001 inch to about 0.04 inch.

In another configuration, the anti-cam out feature further includes a proximal annular rib portion, spaced-apart from the distal annular rib portion. The proximal annular rib includes a second contact surface extending substantially circumferentially around a second portion of the fitment post when oriented in the gripping position. The second contact surface has a transverse cross-sectional dimension substantially similar to a transverse cross-sectional dimension of the second portion of the fitment post.

The gripping mechanism includes an expandable collet device adapted for selective movement between a gripping position, gripping the fitment retaining barb, and a release position, enabling selective axial release of the retaining head of the fitment retaining barb from the gripping mechanism. The collet device includes a proximal base portion, and a plurality of resilient finger members extending distally toward the wand opening, and each the resilient finger member being cantilever mounted thereto for radial movement of a distal tip of the respective finger member between the gripping position and the release position.

In one embodiment, the distal tip portions of the finger members cooperate to define a mouth portion of the collet device. The finger members are positioned generally radially amend a longitudinal axis of the collet device in a manner collectively defining a collet recess therein formed for receipt of the retaining head of the fitment when in the gripping position. Each the distal tip of the finger member includes a tine portion extending radially inward, and defines a proximal facing contacting surface such that, when the retaining head of the fitment is positioned in the gripping position of the collet device, the contacting surfaces of the respective tine portions substantially prevent axial pull-out in a direction away from the gripping mechanism.

In another specific configuration, the gripping mechanism includes a plunger mechanism selectively engaging the collet device for movement between the gripping position and the release position. The plunger mechanism includes a plunger head adapted for selective reciprocating movement thereof along the longitudinal axis of the collet device between a disengaged condition, corresponding to the gripping position of the collet device, and an engaged condition, corresponding to the release position of the collet device.

The gripping mechanism further includes a release device coupled to the plunger mechanism for selective movement of the plunger head between the disengaged and the engaged condition. The release device includes a slide switch slideably mounted to the maneuvering wand for operation at the handle portion between the disengaged condition and the engaged condition. The release device further includes a pushrod extending through the wand cavity from proximate the handle portion to proximate the attachment portion. A distal end thereof is mounted to the plunger head, and an opposite proximal end thereof being mounted to the slide switch for translation of movement from the slide switch to the plunger head.

In yet another embodiment, the cleaning implement fitment includes a back plate upon which the cleaning element is mounted. The back plate is configured to provide lateral support to the cleaning element during use thereof, and the fitment post extending longitudinally therefrom. The back plate being configured such that a force required to bend the back plate is less than that required to radially displace one or more of the finger members toward the release position. The back plate defines one or more flexible zones adapted to reduce the stiffness of the back plate plurality of stiffness reducing grooves spaced-apart about the plate longitudinal axis thereof, and extending generally radially outward from an interior portion of the disk.

In another aspect of the present invention, a cleaning tool assembly is provided adapted to removably mount a cleaning implement thereto. The cleaning implement includes a cleaning element mounted to a fitment having an elongated, axially extending post terminating at a barb portion thereof. The tool assembly includes an elongated maneuvering wand having a handle portion and a distal implement attachment end thereof, and a gripping mechanism coupled to the wand attachment end. The gripping mechanism is configured to releasably grip the barb portion of the fitment post to releasably mount the cleaning implement to the maneuvering wand in a gripping position. The tool assembly further includes an anti-cam out feature adapted to radially engage the fitment post when the gripping mechanism is positioned in the gripping position, and when the cleaning implement is subjected to a load radial to the longitudinal axis of the fitment post. The anti-cam out feature is adapted to substantially limited to pivotal movement of the longitudinal axis of the fitment post, relative the longitudinal axis of the gripping mechanism, to not more than about 0 degrees to about 25 degrees.

In one embodiment, a seal device is included positioned is a gap between the distal annular rib portion and the proximal annular rib portions. The seal device cooperates with the fitment post when in the gripping position such that a fluid-tight seal is formed therebetween to prevent fluid flow into the cavity.

In another aspect of the present invention, a cleaning tool assembly is adapted to removably mount a cleaning implement thereto. The cleaning implement includes a cleaning element mounted to a fitment. The tool assembly includes an elongated maneuvering wand having a handle portion, and a distal implement attachment end thereof. The attachment end defines a wand opening into a cavity of the wand, and the wand opening being formed and dimensioned for axial insertion of the fitment post therein. A radially expandable gripping mechanism is disposed in the cavity. The mechanism is adapted for movement between a naturally biased gripping position, releasably gripping the fitment retaining barb through the wand opening, and a release position, radially expanding the gripping mechanism by an amount sufficient to enable axial release of the retaining barb therefrom. The gripping mechanism is configured to axially retain the retaining barb therein with an axial retention force. A release device includes a manual actuation device mounted to the handle portion, and adapted for manual axial movement between a disengaged condition and an engage condition, slideably engaging the gripping mechanism for expansion thereof toward the release position. The gripping mechanism and the release device are configured to interactively cooperate to substantially minimize frictional drag therebetween in a manner such that a maximum, manual release force, at the actuation device, required to manually move the release device from the disengaged condition to the engaged condition, and thus, the gripping mechanism from the gripping position to the release position, is substantially less that the axial retention force of the gripping mechanism.

In one example, the axial retention force is in the range of about live (5) lbf. to about fifteen (15) lbf., and the release force is in the range of about 1.0 lbf. to about 6.0 lbf. In another embodiment, the axial retention force is in the range of about nine (9) lbf. to about eleven (11) lbf., and the release force is in the range of about 1.75 lbf. to about 3.0 lbf.

In another specific embodiments the release device includes a plunger head, adapted for sliding engagement, with the collet device for selective reciprocating movement thereof along the longitudinal axis of the collet device between a disengaged condition, corresponding to the gripping position of the collet device, and an engaged condition, urging the collet device toward the release position. The plunger head is operated for selective reciprocating movement thereof along the longitudinal axis of the collet device between the disengaged condition, corresponding to gripping position of the collet device, and the engaged condition. In this engaged condition, a cam surface of the plunger head contacts an opposed underside displacement surface of the finger members causing displacement of the respective distal tip portions thereof radially outward from the gripping position toward the release position.

To reduce frictional drag, each the underside displacement surface includes at least two spaced-apart upstanding contact ribs extending in a direction longitudinal to the collet device. Each the contact rib cooperates with the cam surface of the plunger head to reduce frictional contact therebetween as the plunger head reciprocates between the disengaged condition and the engaged condition. A cam surface at a distal portion of the plunger head is convex-shaped to further reduce frictional contact between with the contact ribs as the plunger head reciprocates between the disengaged condition and the engaged condition.

In yet another arrangement, a contact angle between the earn surface of the plunger head and the contact ribs of the underside displacement surfaces is in the range of between about three (3) degrees per side to about twenty (20) degrees per side.

In another embodiment, the maneuvering wand includes a gradually curved portion thereof between the handle portion and the attachment end. The pushrod is substantially similarly curved at a corresponding portion thereof when positioned in the cavity of the maneuvering wand. The pushrod is sufficiently flexible to enable axial movement thereof through the wand cavity between the disengaged condition and the engaged condition. Further, the pushrod is sufficiently stiff to enable the plunge mechanism to engage the collet device from the gripping position to the release position.

Throughout the interior of the maneuvering wand is a plurality of support bearings spaced-apart along the wand cavity. These bearings cooperate with the pushrod to enable unobstructed axial movement thereof between the disengaged condition and the engaged condition. Each support bearing is plate-like, and includes a bearing surface defining a respective aperture enabling reciprocal passage of the pushrod therethrough. Further, each bearing surface of the support bearing is convex shaped to reduce frictional contact with the pushrod during movement between the disengaged condition and the engaged condition.

BRIEF DESCRIPTION OF THE DRAWINGS

The assembly of the present invention has other objects and features of advantage which will be more readily apparent from the following description of the best mode of carrying out the invention and the appended claims, when taken in conjunction with the accompanying drawing, in which:

DETAILED DESCRIPTION OF THE INVENTION

Figure 1:
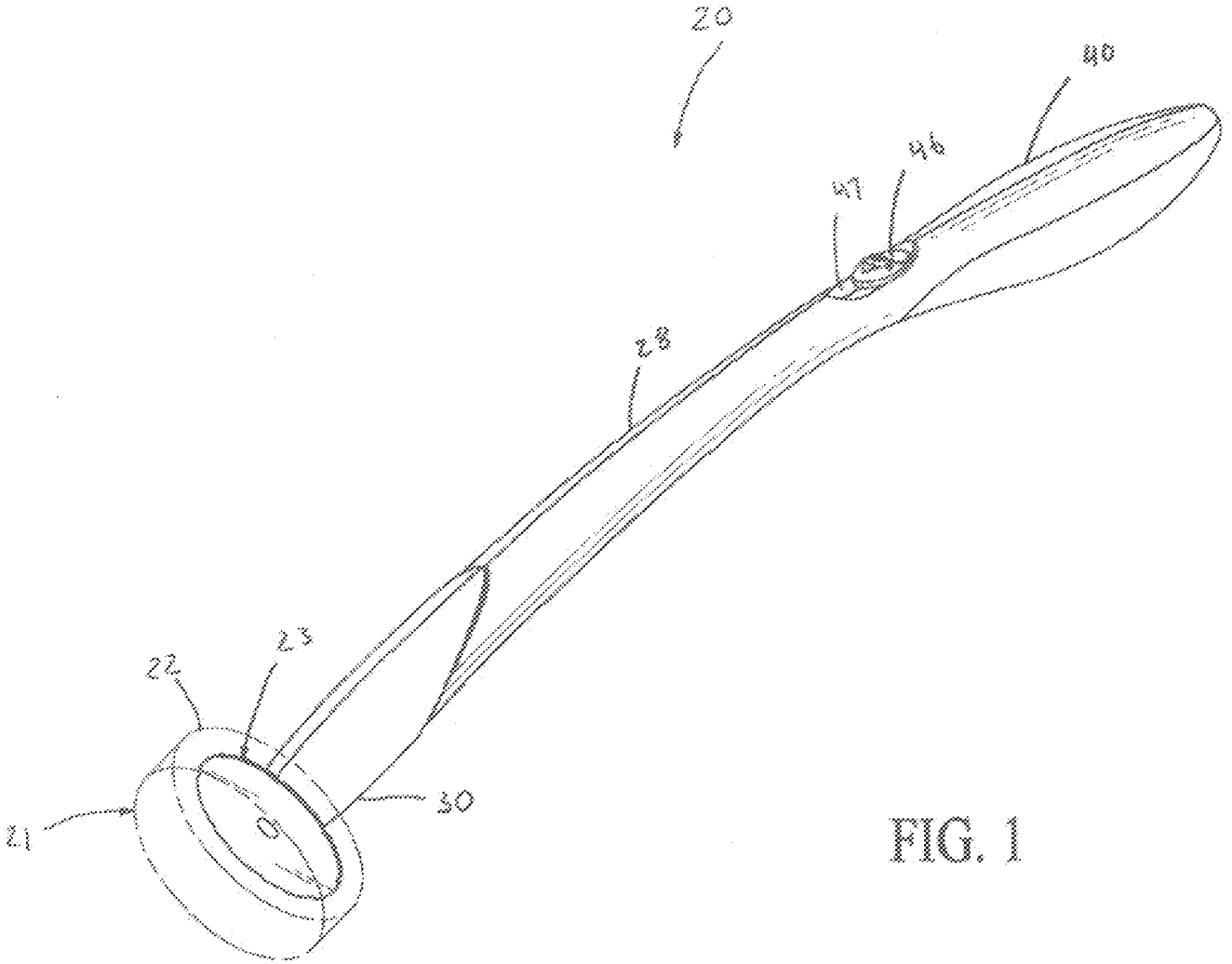
FIG. 1 is a top perspective view a cleaning tool assembly constructed in accordance with the present invention in a gripping position.
Figure 2:
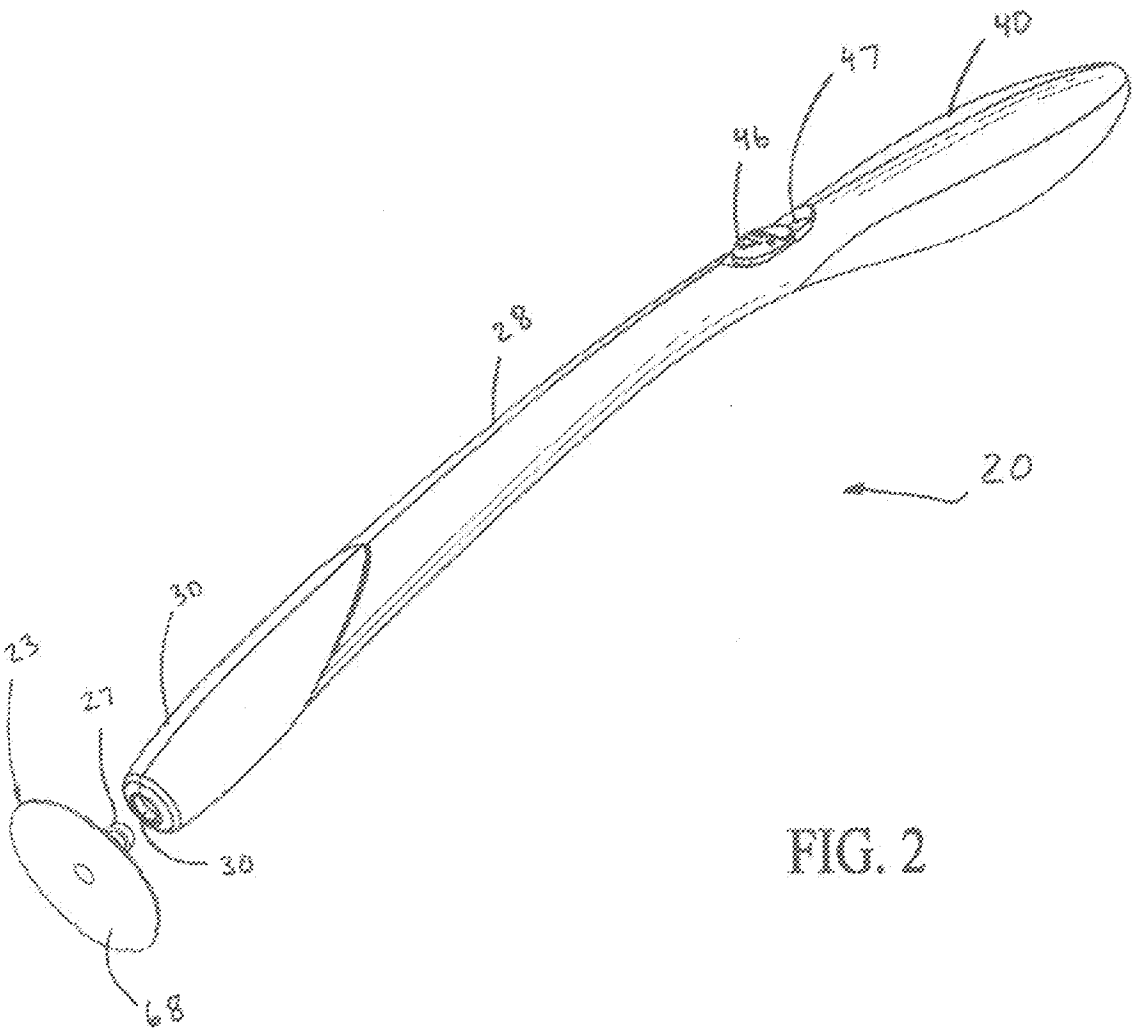
FIG. 2 is a top perspective view of the cleaning tool assembly of FIG. 1 in a release position.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

Figure 4:
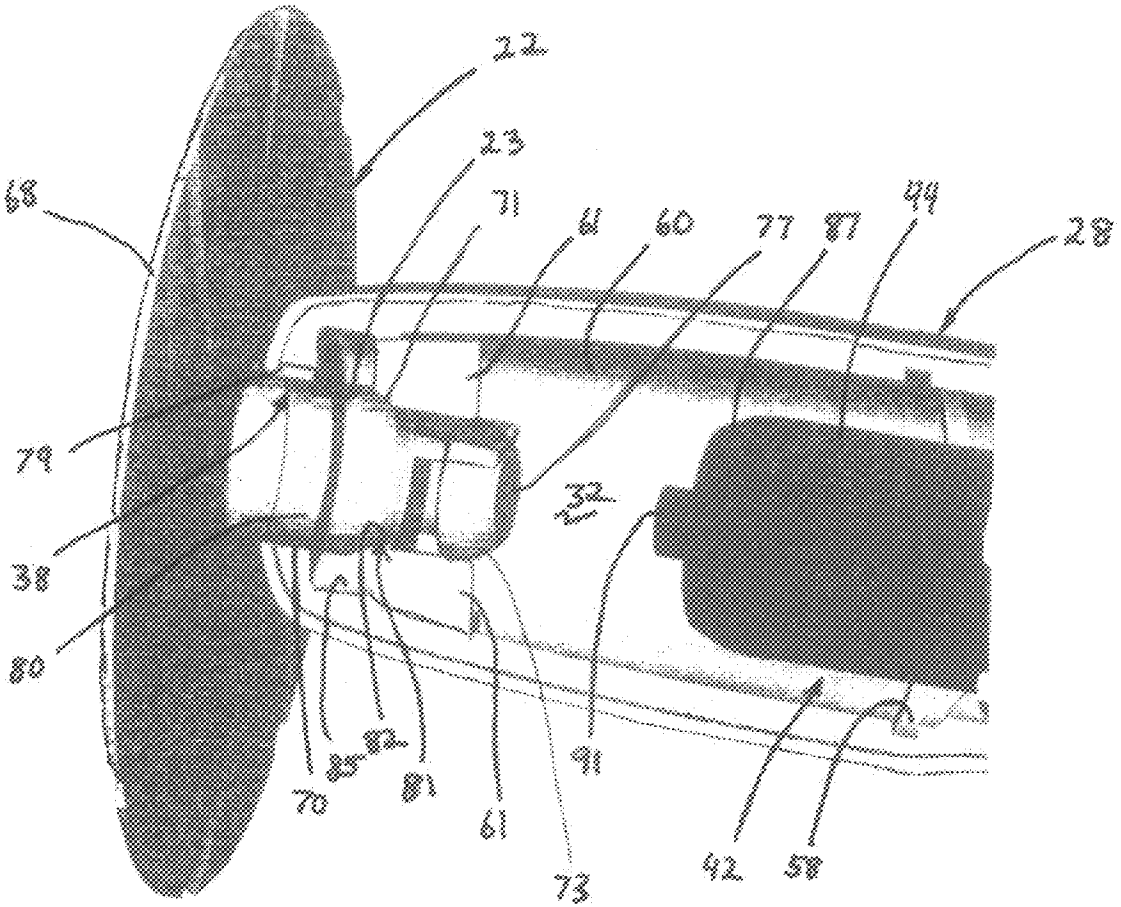
FIG. 4 is an enlarged, fragmentary, side perspective view of the interior of an attachment end of the cleaning tool assembly of FIG. 1, shown without a collet device for illustrative purposes.
Figure 5A:
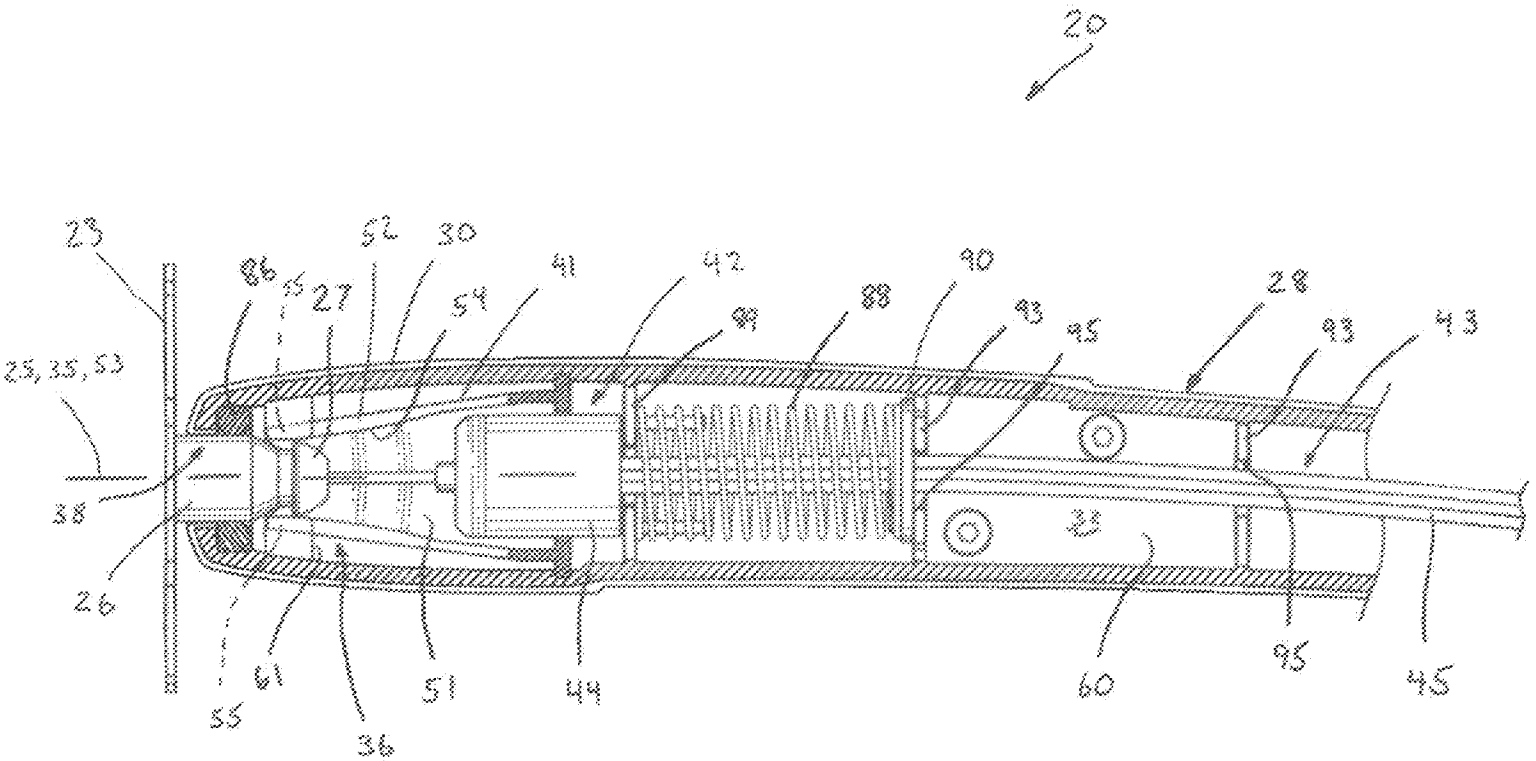
FIG. 5A us an enlarged, side elevation view, in cross-section, of the attachment end of the cleaning tool assembly of FIG. 1, illustrated in the gripping position.
Figure 5B:
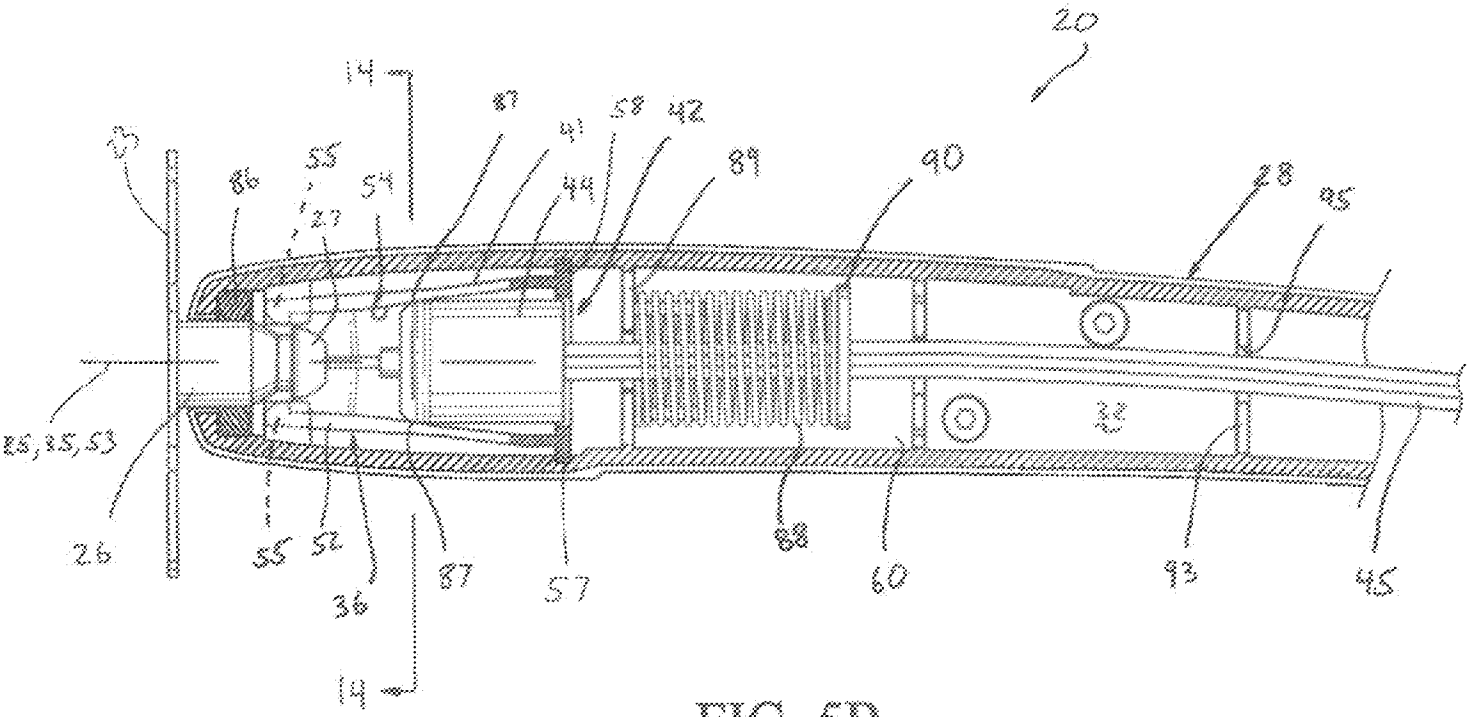
FIG. 5B is a side elevation view, in cross-section, of the attachment end of the cleaning tool assembly of FIG. 5A, illustrated in an intermediary release position.

Referring now to FIGS. 1-5, a cleaning tool assembly, generally designated 20, is provided having a disposable cleaning implement 21 having a cleaning element 22 mounted to a fitment 23. As shown in FIG. 6, the fitment 23 includes an elongated post 26 extending axially from the cleaning element 22 along the longitudinal axis 25 thereof. A retaining barb 27 is positioned at a distal end of the elongated post 26. The tool assembly 20 includes an elongated maneuvering wand 28 having a handle portion and a distal implement attachment end 30 thereof. The attachment end 30 defines a wand opening 31 into a cavity 32 of the wand 28. The wand opening 31 is formed and dimensioned for axial insertion of the fitment post 26 therein. A gripping mechanism is disposed in the cavity 32, and defines a mouth portion 33 substantially co-axially aligned with a longitudinal axis 35 of the wand opening 31. The gripping mechanism 36 is configured to receive the fitment retaining barb 27 through the mouth portion 33, and releasably grip the fitment retaining barb 27 for axial retention there when in a gripping position of the gripping mechanism 36 (FIGS. 1 and 5A). The tool assembly further includes an anti-cam out feature, generally designated 38, adapted to radially engage the fitment post 26, when in the gripping position, to substantial prevent pivotal movement thereof from the longitudinal axis 35 of the wand opening 31 by more than about zero (0) degrees to about twenty-five (25) degrees when the fitment post 26 is subjected to forces radial to the post longitudinal axis 25.

In one aspect of the present invention, a cleaning tool assembly is provided that incorporates an anti-cam device that significantly limits the pivotal motion of the cleaning head fitment in the gripping mechanism, and hence, substantially prevent side ejection from the gripping mechanism. Accordingly, during operational use of the cleaning tool, significantly greater lateral forces can be applied to the cleaning implement during cleaning with a gripping mechanism that would not otherwise be capable of handling such forces. The design of the gripping mechanism, hence, can primarily concentrate on axial retention of the retaining barb. Consequently, the gripping mechanism design is substantially simplified since lateral retention of the retaining barb is of much less concern.

Figure 3:
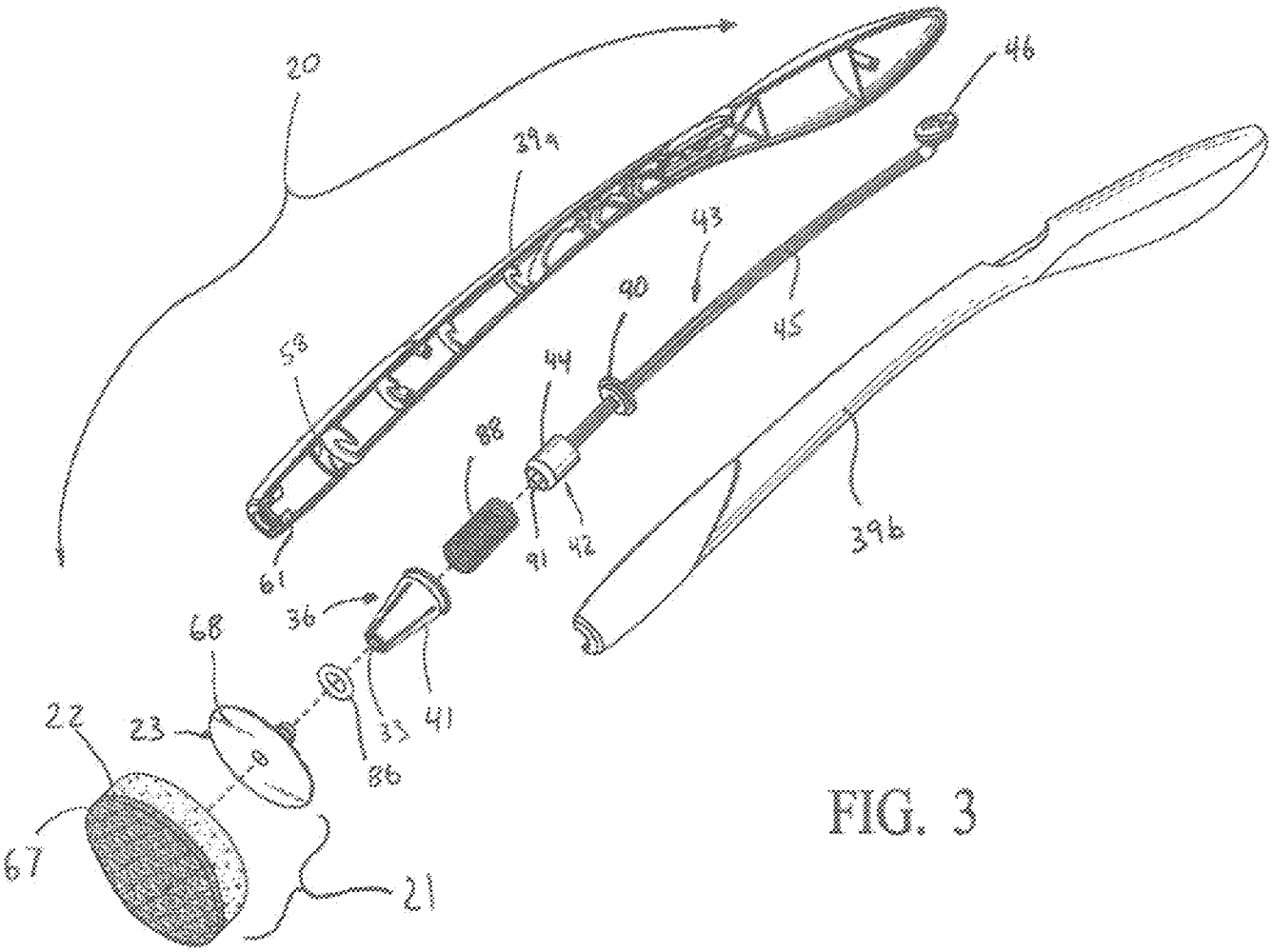
FIG. 3 is an exploded top perspective view of the cleaning tool assembly of FIG. 1.

Referring now to FIGS. 3 and 5, the cleaning tool assembly 20 will now be generally described. The maneuvering wand 28 is preferably provided by elongated 2-piece shell structures 39*a* and 39*b* that collectively define the wand cavity 32 extending longitudinally therethrough. The maneuvering wand is preferably gradually curved, having an increasing radius of curvature from the handle portion to the attachment end. Such gradual curvature is not only aesthetically pleasing, but is operably functional in that this shape facilitates maneuverability of the tool during use.

At one end of the maneuvering wand 28 is a handle portion 40 adapted for operable gripping of the tool assembly so that the user can handle and manipulate the cleaning implement 21. At the opposite attachment end 30 of the wand is the gripping mechanism 36 that is configured to releasably grip the fitment retaining barb 27 for mounting of the cleaning implement to the wand. The wand opening 31 into the wand cavity 32 is positioned at the distal attachment end 30. In one specific configuration, as indicated, the maneuvering wand may be comprised of two generally mirror-image half-shell members 39*a*, 39*b* which are snap-fit, adhered or fastened together. More preferably, at least the attachment end portion the half-shell members are sonically welded so as to be liquid or water impervious during cleaning use. The half-shell members 39*a*, 39*b* may be composed of any suitable material, but are preferably comprised of an injection molded plastic polymer such as polyethylene, polypropelene, PVC, nylon, ABS-PC and other ABS blends, and NORYL®, etc.

The gripping mechanism 36 that releasably secures the cleaning implement 21 to the maneuvering wand 28 includes a radially expandable collet device 41 (FIGS. 7-9) disposed in the wand cavity 32 proximate to the wand opening. A distal portion of the collet device 41 defines the mouth portion 33 that is formed to receive the fitment retaining barb therethrough. In the gripping position (FIGS. 1 and 5A), the transverse cross-sectional dimension of the mouth portion 33 is smaller than that of the retaining barb 27, thereby axially retaining the fitment post 26 therein. In the release position (FIGS. 2, 5B and 5C), the transverse cross-sectional dimension of the mouth portion 33 is radially expanded to a dimension greater than that of the retaining barb 27, thereby permitting axial release of the retaining barb 27 therefrom.

To control the operation of the gripping mechanism 36, a plunger mechanism 42 is included that cooperates with the resilient collet device 41 to selectively expand the mouth portion 33 thereof radially outward from the gripping position to the release position. The gripping mechanism further includes a release device 43 that cooperates with the plunger mechanism 42 for selective control of the collet device by the user between the gripping and release positions. More specifically, as best viewed in FIGS. 3 and 11, the plunger mechanism 42 includes a plunger head 44 mounted to the distal end of a pushrod 45. Both the plunger head 44 and the pushrod 45 are operably disposed in the wand cavity 32, and configured for axial displacement therein. The release device includes a slide switch 46 mounted at the opposite end of the pushrod 45, which in turn is slideably mounted in a guide track 47 proximate to the handle portion 40 of the maneuvering wand 28. Accordingly, as will be described in greater detail below, the slide switch is selectively operated between a disengaged condition (FIGS. 1 and 5A), corresponding to the gripping position of the gripping mechanism, and an engaged condition (FIGS. 2, 5B and 5C), corresponding to the release position of the gripping mechanism. It will be appreciated, however, that while a slide switch is preferred, many other manual release device actuators may be applied such as a push button device positioned at the handle portion or at the end thereof, a trigger or twist knob.

Figure 7:
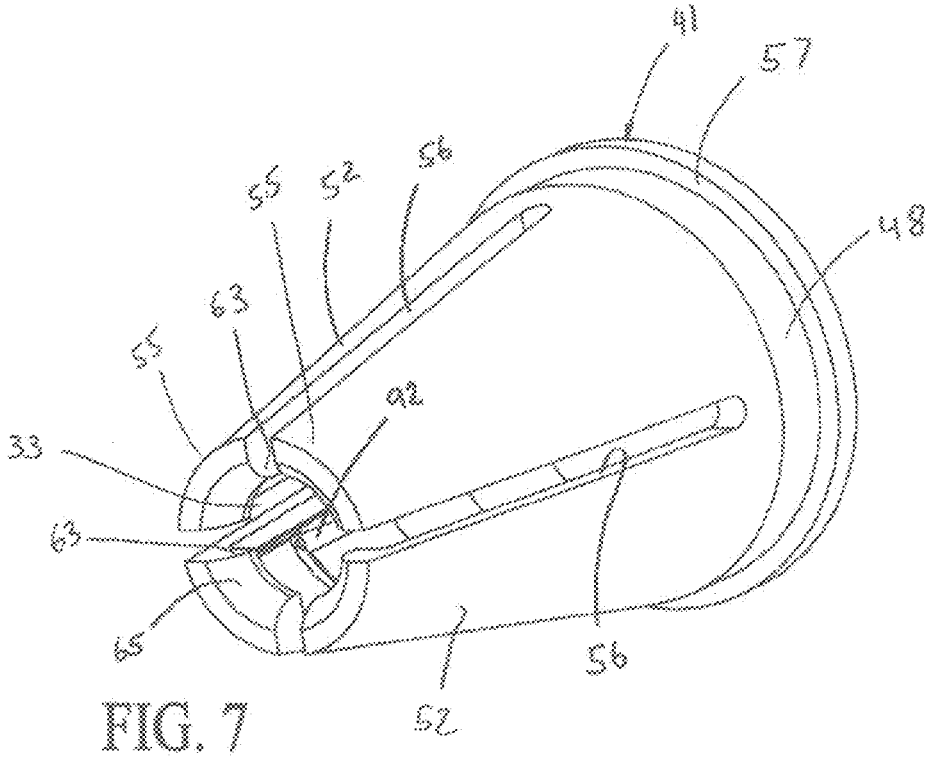
FIG. 7 is an enlarged, front perspective view of a collet device of the cleaning tool assembly of FIG. 1.
Figure 8:
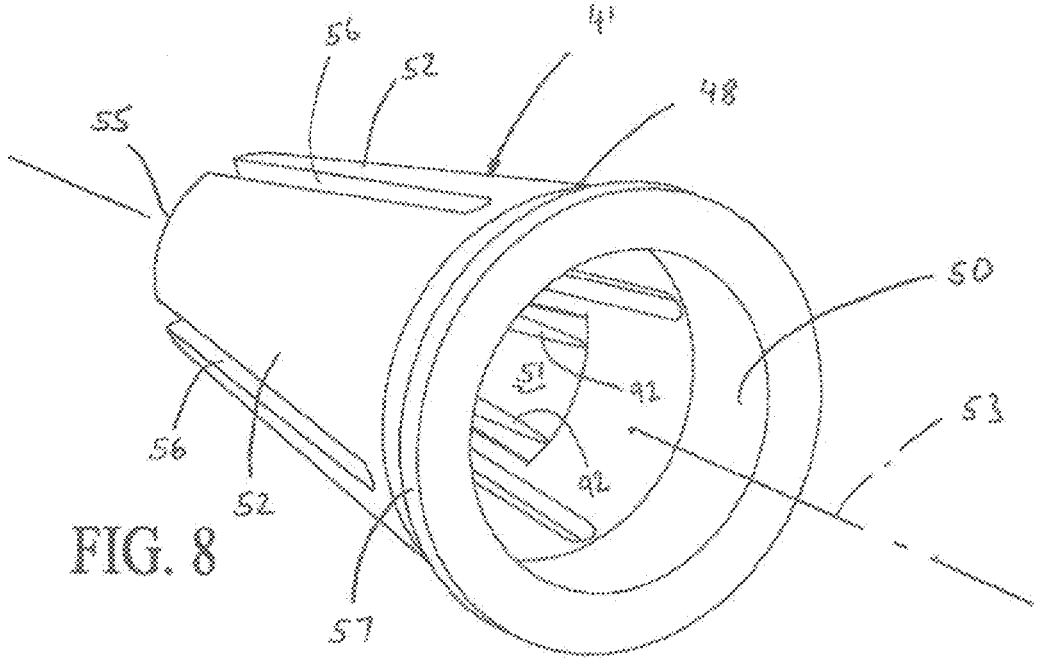
FIG. 8 is a rear perspective view of the collet device of FIG. 7.
Figure 9:
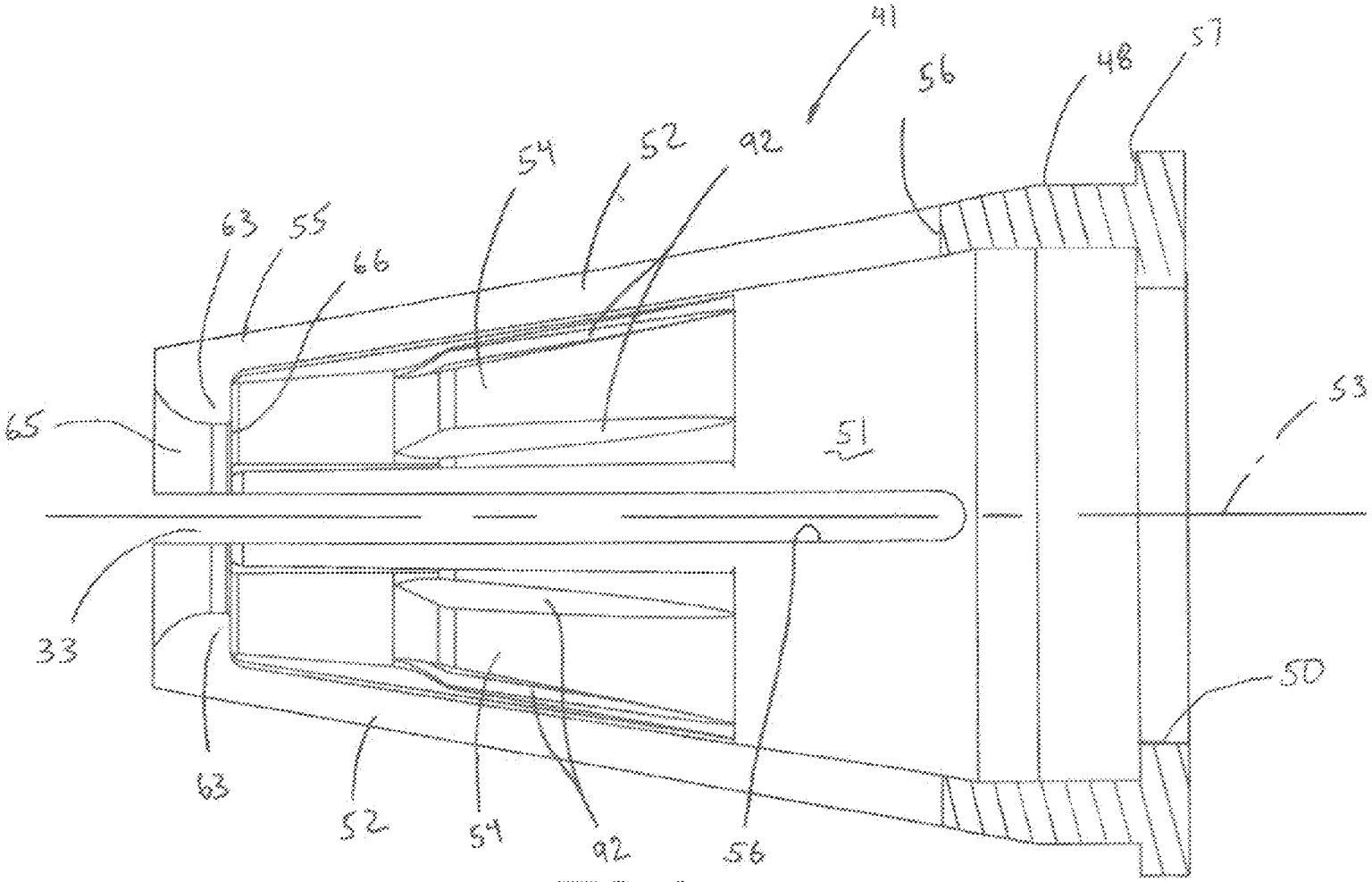
FIG. 9 is an enlarged, side elevation view, in cross-section, of the collet device of FIG. 7.

In one specific embodiment the collet device 41 is conical shaped, and includes an annular base portion 48 defining a proximal opening 50 into a collet recess 51 thereof (FIGS. 7-9). Extending distally from the annular base portion 48 is a plurality of finger members 52, each of which is positioned radially about a longitudinal axis 53 of the collet device 41. Collectively, the interior facing displacement surfaces 54 of the finger members define a conical-shaped collet recess 51 upon which the retaining barb 27 of the fitment 23 is received.

FIG. 9 illustrates that finger members 52 are cantilever mounted to the annular base portion 48 of the collet device 41 enabling a distal tip portion is of each finger member 52 (collectively the collet distal portion) to pivotally reciprocate radially outward. In their natural, rested state, the finger members 52 of the collet device 41 oriented in the gripping position. Consequently, when the distal tip portions 55, which collectively define the mouth portion 33, are be expanded from the gripping position (FIGS. 1 and 5A) toward the release position (FIGS. 2, 5B and 5C), the resilient finger members 52 bias the distal tip portions 55 back toward the gripping position.

Accordingly, to provide such resiliency, the hollow collet device 41 must be composed of a flexible, yet resilient material. Such suitable rigid, yet resiliently flexible materials for the collet device 41, include plastic polymers such as polyethylene, nylon, ABS, NOREL®, etc, with optional low friction additives including TEFLON®.

In one specific configuration, the collet device 41 includes four independent finger members 52 cantilever mounted to the base portion 48. Each finger member 52 is separated by an alignment slot 56 extending longitudinally therealong. It will be appreciated, of course, feat the number of independent finger members 52 can be increased or decreased without departing from the true spirit and nature of the present invention. Collectively, each finger member 52 is circumferentially spaced about the longitudinal axis 53 to form collet recess 51 therein.

When the conical collet device 41 is positioned in the wand cavity 32, at the attachment end 30 of the maneuvering wand 28 (FIG. 5), the mouth portion 33 of the collet device is positioned substantially adjacent to and in co-axial alignment with the wand opening 31. This permits axial receipt of the fitment post 26 and retaining barb 27 into the collet mouth portion when they are inserted through the wand opening 31.

To axially secure the collet device 41 in the wand cavity 32, relative the maneuvering wand 28, an annular lip portion 57 of the collet device extends radially outward from the base portion 48. As shown in FIGS. 4 and 5B, this annular lip portion 57 engages a corresponding annular slot 58 formed in the interior walls 60 of the maneuvering wand 28 which generally define the interior wand cavity 32. Accordingly, when the collet device 41 is positioned in the wand cavity 32 such that the annular lip portion 57 is engaged in the annular slot 58, the collet device will be axially secure relative the maneuvering wand.

Moreover, the maneuvering wand 28 includes a plurality of alignment webs 61 extending radially into the wand cavity 32 from the interior walls 60 of the maneuvering wand. Each generally triangular-shaped alignment web 61 corresponds to a respective alignment slot 56 of the collet device 41, and is sized to slideably insert therein between the adjacent finger members 52. Accordingly, as the finger members 52 guidably reciprocate between the gripping position and the release position, the finger members expand and contract into the recesses formed between the radially spaced alignment webs 61.

Turning now to FIG. 9, each distal tip portion 55 of the finger members 52 includes a tine portion 63 extending radially inward toward the longitudinal axis 53 thereof. These tine portions 63 define the diameter of the collet mouth portion 33, and, as will be described, collectively function to axially retain the fitment retaining barb 27 to the maneuvering wand in the gripping position. A distal facing side of the tine portion 63 is a distal facing cam surface 65, while a proximal facing contact surface 66 is disposed on the opposite side thereof. Importantly, the proximal facing contact surface 66 is substantially contained in a plane substantially perpendicular to the longitudinal axis of the collet device 41.

In accordance with the present invention, when the fitment 23 of the cleaning implement 21 is axially inserted into the wand opening 31 of the maneuvering wand 28 toward the gripping mechanism 36, the fitment 23 and the collet device 41 cooperate to axially snap-fit together in the gripping position. Before this procedure is described in detail, however, the cleaning implement will be briefly detailed.

Referring now to FIG. 6, the cleaning implement 21 is comprised of the a pliable cleaning element 22 mounted to the fitment 23. The cleaning element 22 is preferably cylindrical-shaped, but may be any other useful head shape including elliptical, rectangular or square with rounded edges. The head is also preferably composed of a pliable, resilient, absorbent material with sponge-like properties, such as polyether and polyurethane sponges.

In some embodiments, a scrim 67 may be included which may be impregnated or partially composed of a cleansing material such as soap. These disposable cleaning elements and compositions are disclosed in more detail in U.S. patent application Ser. No. 10/663,496, filed Sep. 12, 2003, now U.S. Pat. No. 7,127,768; entitled DISPOSABLE CLEANING HEAD, and incorporated by reference in its entirety for all purposes.

The fitment 23 (FIGS. 3 and 6) upon which the cleaning element 22 is mounted, includes a disk shaped back plate 68 that provides support and additional stiffness to the cleaning element. Such additional backing is important in that it allows the user to apply a greater cleaning pressure to the cleaning element than would otherwise be allowed given the nature of the material of the cleaning element. As will be described in greater detail below and in accordance with the present invention, the backing stiffness is selected so as to permit collective bending of the cleaning element 22 and the back plate under predetermined beading force conditions. These properties can be manipulated through the proper selection of material composition, material thickness and structural inclusions which, as mentioned, will be described in greater detail below.

Extending axially from the back plate 68 is a fitment post 26 formed and dimensioned for sliding axial receipt In the wand opening 31. The fitment post 26 is preferably cylindrical shaped at a first portion 70, and tapers inwardly at a distal second portion 71 thereof. The distal second portion 71 is mounted to the retaining barb 27 at a neck portion 72 thereof. As best viewed in FIGS. 3 and 6, the retaining barb 27 further includes a rounded retaining bead 73 which has a transverse cross sectional dimension greater than that of the neck portion 72, but less than that of the fitment post 36. At the intersection between the retaining head 73 and the neck portion 72 is an annular shoulder portion 75 which is generally contained in a plane substantially perpendicular to the longitudinal axis 25 of the fitment 23. The retaining head 73 includes a rounded cam surface 76 that tapers inwardly to a substantially planar engaging surface 77 facing proximally toward the plunger head when mounted in the gripping mechanism 36.

The wand opening 31 and corresponding fitment post 26 are preferably cylindrical-shaped for ease of axial insertion. It will be appreciated, however, that the transverse cross-sectional dimension may not be circular, and/or may be keyed. In such a configuration, of course, for axial insertion of the fitment post into the wand opening would first require some alignment.

In accordance with the present invention, when the fitment post 26 is axially inserted into the wand opening 31, the rounded cam surface 76 initially abuts against the distal facing cam surfaces 65 of the respective tine portions of the collet device 41. As the fitment post 26 is further axially urged into the wand opening 31 and against the distal facing cam surfaces 65 of the finger members 52, the distal tip portions 55 thereof are caused to spread apart radially expanding the mouth portion 33. The distal facing cam surfaces 65 have a curvature similar to that of the rounding cam surface 76 of the retaining bead 73 which facilitate sliding contact therebetween.

Accordingly, as the distal facing cam surfaces 65 of the respective finger members 52 are sufficiently radially displaced, the fitment post 26 is axially inserted until the retaining head extends just past the tine portion 63 of the finger members. Due to the resiliency of the finger members 52, which are biased radially inward toward the gripping position, once past the retaining head 73, the tine portions 63 are urged back toward fee gripping position where they engage the annular shoulder portion 75 of the retaining barb 27 (FIG. 5A). In the gripping position, thus, the proximal facing contact surfaces 66 of the finger tine portions 63 contact and axially retain the annular shoulder portion 75 of the retaining head 73.

An audible and/or tactile cue feature is incorporated that informs the user that the cleaning implement 21 is properly retained in the gripping mechanism 36. Hence, upon securing the fitment 23 in the collet device 41, in the gripping position, the retaining barb 27 and the finger members cooperate to audibly and/or tactily "click". In one configuration, this audible and/or tactile cue may be provided by the structural configuration and resiliency of the finger members 52 as the corresponding tine portions 63 are moved just past the retaining head 73 of the retaining barb.

The mounting arrangement of the present invention provides a significant axial holding force between the fitment and the gripping mechanism in a direction away from the wand opening 31. However, when a lateral force radial or perpendicular to longitudinal axis 53 of the collet device 41 (represented by arrow 78 in FIG. 13) is applied to the fitment post, such as during normal use of the cleaning tool assembly, these loads would only need to overcome radial resiliency force of one of the finger members 52 at distal tip portion 55 in order to dislodge the retaining barb 27 from the collet device 41 of the gripping mechanism 36 (i.e., side ejection or off-axis angled pull-out).

In accordance with fide present invention, as mentioned above, an anti-cam out feature or structure 38 is incorporated, into the maneuvering wand 28 that cooperates with the fitment to substantial prevent pivotal movement of the fitment post while mounted in the gripping mechanism 36. In particular, the anti-cam out feature 38 limits the pivotal movement of the fitment post relative the longitudinal axis 53 of the gripping mechanism 36 (and hence the wand opening 31) by not more than about zero (0) degrees to about twenty-five (25) degrees. Accordingly, when a lateral load is placed upon the cleaning implement and transferred to the fitment post (such as during use), the anti-cam out features substantially absorb the lateral loads so that they are not transferred to and placed upon the collet finger members 52, causing inadvertent side ejection or release of the fitment 23.

Much higher loads can thus be placed upon cleaning implement, during use, than might otherwise be permitted with the current gripping mechanism design due to potential cam-out of the retaining barb 27 from, the collet device 41. As mentioned, this anti-cam out feature 38 enables the design of the collet device 41 to concentrate on axial retention of the retaining barb 27, as opposed to simultaneously providing lateral or radial retention thereof. Consequently, the gripping mechanism design is substantially simplified, and thus less costly, since collet device does not require resistance to such lateral loads.

Figure 13:
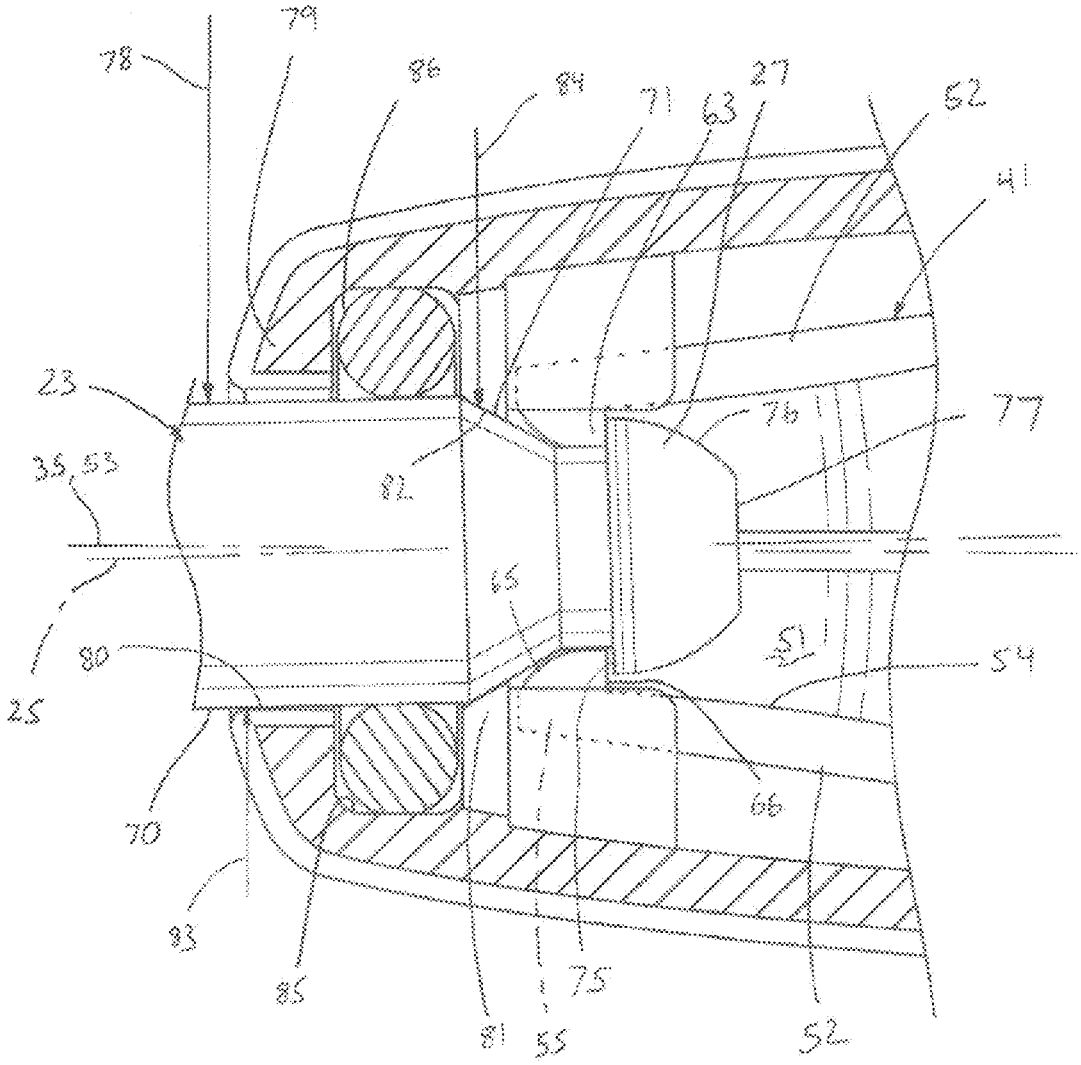
FIG. 13 is a fragmentary, enlarged, side elevation view, in cross-section, of the attachment end of the tool assembly of FIG. 5A.

As best illustrated in FIGS. 4 and 13, the anti-cam out feature 38 includes a distal annular rib 79 positioned substantially adjacent the wand opening 31 of the maneuvering wand. The distal annular rib 79 includes a first contact surface 80 extending substantially circumferentially around the first portion 70 of the fitment post 26 when the retaining barb 27 is in the gripping position. In one specific embodiment, the first contact surface 80 is integrally formed with the maneuvering wand 28 such that the first contact surface essentially defines the wand opening 31 into fee wand cavity 32.

To prevent significant lateral displacement of the fitment post 26 when positioned in gripping mechanism, the first contact surface 80 of the distal annular rib 79 is dimensioned to have a transverse cross-sectional dimension substantially similar to that of the first portion 70 of said fitment post 26. As mentioned, it will be appreciated that while the transverse cross-sectional dimensions herein are shown and described as generally circular they could be provided by other geometric shapes as well. In fact, other such shapes, together with the like cross-sectional dimensions of the first contact surfaces, would be beneficial in preventing or reducing axial rotation of fee fitment post 26 relative, the maneuvering wand.

In one specific arrangement, with the diameter of the fitment post 26 in the range of 0.060 inch to about 0.750 inch, and more preferably about 0.38 inch, the tolerance between the distal annular rib 79 and the first portion 70 of the fitment post 26 is in the range of about 0.001 inch to about 0.040 inch. Moreover, the longitudinal length of the first contact surface 80 of the distal annular rib 79 is in the range of about 0.040 inch to about 1.00 inch, and more preferably about 0.250 inch. The anti-cam out feature 38 of the present invention further includes a proximal annular rib 81 axially spaced-apart from out first contact surface 80 of the distal annular rib 79.

As FIG. 13 best illustrates, similar to the distal annular rib 79, the proximal annular rib 81 includes a second contact surface 82 that extends substantially, circumferentially around the fitment post 26, but at a location axially spaced from the first contact surface 80 of the distal annular rib 79. Also similar to the distal annular rib 79, the second contact surface 82 of the proximal annular rib 81 provides a transverse cross-sectional dimension substantially similar to a transverse cross-sectional dimension of the second portion 71 of the fitment post 36.

Accordingly, a sufficient lateral load urged upon the cleaning implement (represented by anew 78), translating to any pivotal movement of the fitment post 26 relative the longitudinal axis of the collet device 41, will eventually cause abutting contact between the first contact surface 80 of the distal annular rib 79 and the first portion 70 of the fitment post, on one side thereof. The rigid first contact surface 80 will provide an opposing force (represented by arrow 83) acting upon the fitment first portion 70, causing it to teeter or pivot. Such pivotal movement will also cause abutting contact between the second contact surface 82 of the proximal annular rib 81 and the second portion 71 of the fitment post, on an opposite side thereof. Similarly, the rigid second contact surface 82 will provide an opposing force (represented by arrow 84) acting upon the fitment second portion 71. Consequently, the opposed contact between the relatively rigid first and second contact surfaces, and the relatively rigid fitment posts limit the pivotal movement relative the collet device to not more than the mentioned about zero (0) degrees to about twenty-five (25) degrees. More preferably, this range is reduced to about zero (0) degrees to about twelve (12) degrees, and even more preferably zero (0) degrees to about six (6) degrees. In turn, these lateral forces are not translated to the distal tip portions of the finger members to prevent inadvertent cam-out thereof.

It will be appreciated that both the distal and proximal annular ribs are composed of a relatively rigid material. Likewise, the fitment post 26, as mentioned, is also composed of a relatively rigid material. Similar to the other components, these may includes plastic polymers such as polyethylene, nylon, ABS, NOREL®, etc, with optional low friction additives including TEFLON®.

In one embodiment, the proximal annular rib 81 is adapted to engage and seat with the inwardly tapered second portion 71 of the fitment post 26. Thus, the second contact surface 82 similarly tapers inwardly at substantially the same slope as the second portion 71 of the fitment post 26. When the fitment retaining barb is positioned in the gripping position, thus, the second portion 71 substantially seats against the proximal annular rib 81. Due in part to this seating, the fitment post 26 will thus pivot about this region until the first portion 70 of the fitment post contacts the first contact surface 80 of the distal annular rib 79.

To prevent liquid contact with the components of the gripping mechanism 36 during use, a seal 86, preferably an O-ring, is included having a central passage formed for receipt of the fitment post 26 therethrough. This O-ring is disposed in an annular gap 85 (FIG. 4) disposed between the distal annular rib 79 and the proximal annular rib 81 which axially spaces the first and second contact surfaces 80, 82, respectively. The passage through the O-ring 85 is co-axially aligned with the wand opening 31 and mouth portion 33 of the collet device such that upon insertion of the fitment post 26 through the wand opening 31 to the gripping position, the post extends through the O-ring. The O-ring 86 is preferably composed of a resilient non-porous, flexible material, such as rubber or the like. Thus, to form a liquid-tight seal, when the fitment post 26 is positioned in the gripping mechanism, the transverse cross-sectional dimension of the passage of the O-ring is smaller than brat of the fitment post 26. Upon insertion, the O-ring 86 is stretched about the fitment post 26, forming a fluid-tight seal against the fitment post 26 substantially preventing leakage into the wand cavity 32.

Figure 5C:
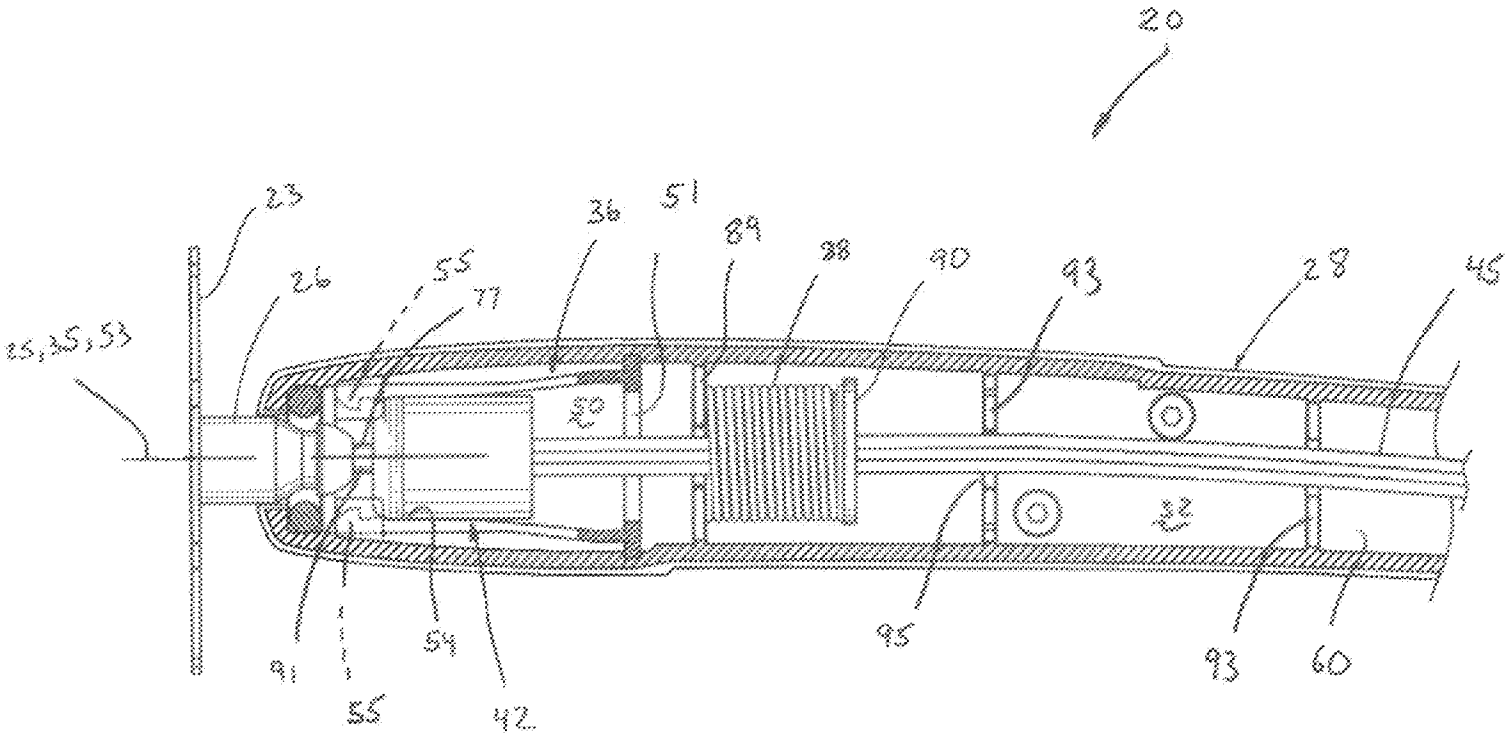
FIG. 5C is a side elevation view, in cross-section, of the attachment end of the cleaning tool assembly of FIG. 5A, illustrated in a full release position.
Figure 6:
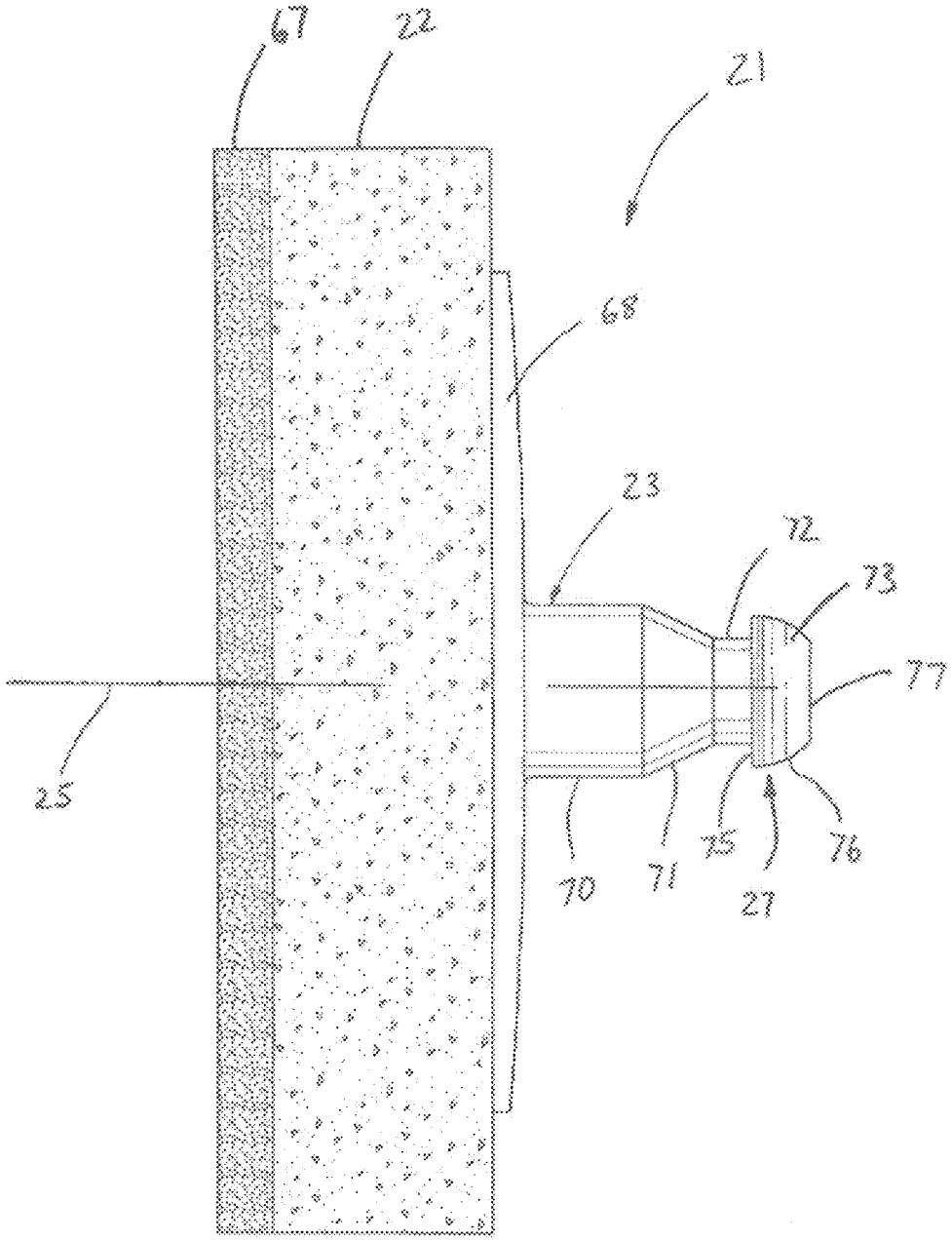
FIG. 6 is an enlarged, side elevation view of a cleaning implement of the cleaning tool assembly of FIG. 1.

Referring now to FIGS. 5A-5C, the release of the cleaning implement 21 from the gripping position (FIGS. 1 and 5A) to the release position (FIGS. 2, 5B and 5C) will now be discussed in detail. As mentioned above, in order to release the fitment retaining barb 27 from the tine portions 63 of the corresponding finger members 52, the mouth portion 33 of the collet device 41 must be radially expanded by a sufficient amount to enable release of the retaining head 73 of the retaining barb 27. Thus, the release device (i.e., the plunger head 44, the pushrod 45 and the slide switch 46) must translate the linear (or axial) displacement thereof (i.e., from the disengaged condition to the engaged condition) to the radial displacement of the distal tip portions of the finger members (i.e., from the gripping position to the release position).

In the disengaged condition (FIG. 5A), it will be understood that the plunger head 44 is completely out of contact with the underside displacement surfaces 54 of the respective finger members 52. This permits the finger members 52 and their distal tip portions 55 to be biased toward their natural gripping position to axially retain the cleaning implement 21, when the retaking barb 27 is contained in the collet device 41 in the gripping position. Moreover, in accordance with the present invention, when the slide switch 46 and plunger head 44 are fully recessed in the disengaged condition (FIGS. 1 and 5A), a dead band region is provided that permits a predetermined distance of travel or play for the slide switch 46 before any engagement of the plunger head with the collet device occurs. Accordingly, the dead band regions substantially eliminates inadvertent release of the fitment 23 from the gripping mechanism since any operation of the slide switch 46 must be more than the predetermined distance, and thus more or less an intentional act.

This dead band region is primarily created by positioning the plunger head 44 of the plunger mechanism 42 out of contact with the underside displacement surfaces 54 of the respective finger members 52. Before any contact of a cam surface 87 of the plunger head 44 occurs, the plunger head 44, and/or the slide switch, is configured so that it must axially displace the predetermined distance (e.g., the dead band distance). In the preferred embodiment, this distance is in the range of about 0.400 inch to about 0.600 inch, and more preferably about 0.480 inch to about 0.530 inch from the fully retracted position of the slide switch.

Briefly, as mentioned, the collet device 41 is biased toward the gripping position through the resiliency of the finger members 52. The release device 43, however, is also biased toward the corresponding disengaged condition, out of contact with the collet device, and where the slide switch is fully retracted. This fully retracted configuration provides the maximum dead hand displacement for the switch.

Hence, a biasing device 88 is provided that biases the release device 43 toward the disengaged condition which in effect fully retracts the slide switch 46 and the plunger head 44. This biasing device 88 is preferably provided by a coiled compression spring disposed about the pushrod 45. One end of the biasing spring 88 abuts against a proximal spring retainer plate 89 coupled to the pushrod 45, while the opposite end of the biasing spring 88 abuts against a distal spring retainer plate 90 mounted to the maneuvering wand 28, and extending across the wand cavity. The length of the biasing spring 88, as well as the distance between the spring plates, are selected such that the biasing spring is always in compression. In this manner, the release device will position the slide switch and the plunger head fully in their disengaged condition, as shown FIGS. 1 and 5A.

Accordingly, any release force applied by the user to move the slide switch 46 toward the engaged condition, while the release device 43 is in the dead band region, must at the very least overcome the opposing force of the biasing spring 88. In one specific embodiment, the biasing force exerted by the biasing spring 88 and urged upon the release device 43 is in the range of about 0.1 lbf about 2.0 lbf.

Figure 10:
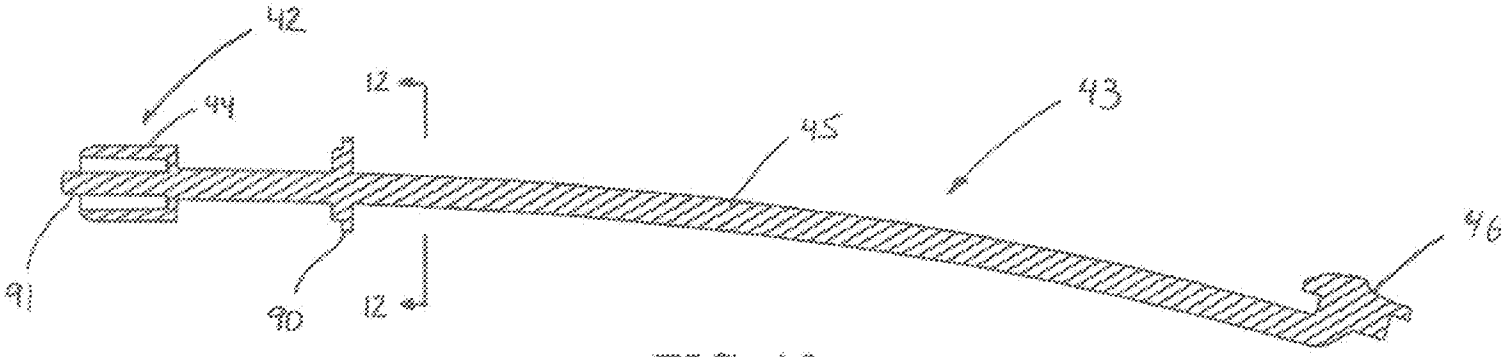
FIG. 10 is an enlarged, side elevation view, in cross-section, of a plunger mechanism and release device of the cleaning tool assembly of FIG. 1.
Figure 11:
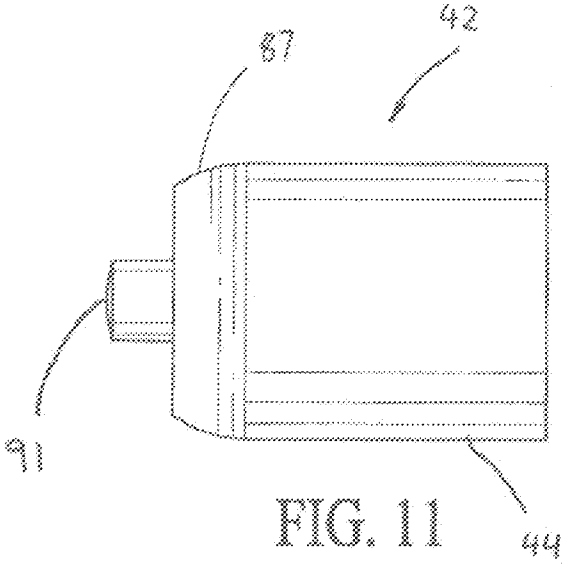
FIG. 11 is a fragmentary, enlarged, side elevation view of the plunger mechanism of FIG. 10.

Referring now to FIGS. 5, 10 and 11, the plunger mechanism 42 includes a cylindrical-shaped plunger head 44 distally mounted to the pushrod 43 that longitudinally reciprocates in the wand cavity 32 between the disengaged, condition (FIG. 5A), free of contact with the collet device 41, to the engaged condition (FIGS. 5B and 5C). The transverse cross-sectional dimension of the plunger head 44 is smaller then and configured to reciprocate through the proximal opening 50 of the collet base portion, and into the collet recess 51. Thus, upon movement of the slide switch 46 in the guide track 47 of the handle portion 40, the pushrod 45 urges the plunger head 44 distally along the wand cavity toward the collet device 41, and through the dead band region until the cam surface 87 of the plunger head 44 slideably contacts an underside displacement surface 54 of each finger member 52. Due to the collective conical, inward taper of the underside displacement surfaces 54, the simultaneous sliding contact between the cam surface 87 of the plunger head 44 and underside displacement surfaces 54 cantilever displace the finger members radially outward toward the release position. At this position, the release force required (at the slide switch 46) to selectively move the gripping mechanism to the full release position is significantly increased (on the order of about 1.0 lbf. to about 6.0 lbf., and more preferably about 1.75 lbf. to about 3.5 lbf.).

As the plunger head 44 advances toward the fully engaged condition, the finger members are caused to increasingly radially expand the mouth portion 33, defined by the tine portions 63 thereof, by a displacement sufficient to release of retaining head 73 of the fitment retaining barb torn the collet device. It will be noted that when the release device 43 surpasses an intermediary threshold position (commencing at FIG. 5B) to a fully extended engaged condition (FIG. 5C), the plunger head 44 and the finger members 52 of the collet device cooperate to temporarily retain the collet device 41 in the release position (with the distal tip portions sufficiently expanded to release the retaining barb). Prior to surpassing the intermediary threshold position, the biasing spring 88 quickly returns the release device 43 to the fully disengaged condition. After the intermediary threshold position, collet device and the plunger head cooperate to delay the return of the release device 43 to the fully disengaged condition by the biasing spring 88. In this manner, together with the increased release force required to move the position the plunger head 44 past the threshold position, release of the cleaning implement must be an intentional act.

In accordance with the present invention, retention of the gripping mechanism 36, plunger mechanism and release device 43 at the fully released position and fully engaged condition is temporary. As will be explained in greater detail below, the contacting components are designed and configured to significantly reduce drag or frictional contact therebetween. Eventually, the biasing spring will overcome the friction forces retaining the plunger head fully engaged against the collet device. Thus, unlike the relatively quick return of the release device to the disengaged condition, by the biasing spring 88, before the threshold position, the return after the threshold position is delayed.

In one specific configuration, the ramped slope of each underside displacement surface 54, corresponding to the region prior to the threshold position, of the corresponding finger member 52 is substantially linear and uniform. It will be appreciated, however, that a more complex profile at this region can be established as well. At the threshold region of the profile of the underside displacement surface 54, the slope thereof increases, and then flattens out toward, corresponding to the full engaged condition (FIG. 9). This flatten profile after the threshold position is what enables the temporary retention of the gripping mechanism 36 in the release position, and the release device 43 in the engaged condition. As above-indicated, biasing spring eventually returns the release device 43 to the disengaged condition, using only the biasing have from the biasing spring 88.

To remove the cleaning implement 21 from the gripping mechanism 36, the tool assembly includes an ejection device 91 at the distal end of the plunger mechanism 42. FIG. 11 best illustrates that the election device 91 includes an ejection post extending distally beyond the cam surface 87 of the plunger head 44. The distal end of the ejection post 91 is slightly domed, and extends from the distal end of the cylindrical body of the plunger head 44 by about 0.1-0.2 inches, and more preferably about 0.13 inches. As cam surface 87 of the plunger bead 44 axially displaces from the disengaged condition to the engaged condition, the ejection post contacts the planar engaging surface 77 of the fitment post 26. Once the distal tip portions 55 of the finger members 52 are sufficiently expanded, the ejection post of the plunger head ejects the retaining barb from the collet device 41 (FIG. 5C).

It will be understood, however, that the cleaning implement 21 will not be fully elected from the maneuvering wand 28. Although the retaining barb 27 has been ejected from the mouth portion 33 of the collet device, the fitment post 26 is still retained in the wand opening 31 of the maneuvering wand. That is, the anti-cam out annular ribs will still loosely support the fitment post therein until the maneuvering wand is directed downward. This gravity release feature is important in that the mere actuation of the release device 43 will not inadvertently eject the cleaning implement 21 from the maneuvering wand 28. For example, even though the user may intentionally actuate the slide switch 46 to release the retaining barb, they may not have the cleaning implement 21 directly over a garbage bin at that time. As such, to cause actual removal of rite cleaning implement from the maneuvering wand, in addition to actuation of the release device, the maneuvering wand must also be directed downwardly for gravity release as well.

In accordance with another aspect of the present invention, as briefly described above, the contacting components of the release device 43 are configured and cooperate to reduce drag or frictional contact therebetween. This is an important feature in that a high axial retention force is necessary to retain the fitment retaining barb 27 in the collet device 41 (preferably in the range of five (5) lbf. to about fifteen (15) lbf.), However, requiring the user to apply a similar force to operate the slide switch past the threshold position would not consumer friendly. In fact, consumer testing has shown that a much more desirable actuator release force range is about one (1) lbf to about five (5) lbf, and more preferably about one and three-quarters (1¾) lbf.

As mentioned, it is the underside contact of the displacement surfaces 54 of the finger members 52 by the cam surface 87 of the axial moving plunger head 44, from the disengaged condition to the engaged condition, that causes the radial expansion of the distal tip portions 55 of the finger members 52, from the gripping position to the release position. The radial expansion is primarily generated by the frictional contact between the axial displacement of the cam surface 87 of the plunger head 44 and the collective conically, shaped underside displacement surfaces 54 of the finger members 52. To displace the slide switch 46 from the disengaged condition to the fully engaged condition, therefore, the user must primarily overcome the sum of these frictional forces and the spring biasing force caused by the compression of the biasing spring 88. Accordingly, by significantly reducing the frictional drag between these working surfaces of the inter-engaging components, the desired release force at the slide switch 46 can be more easily achieved while at the same time providing the necessary holding force by the gripping mechanism.

The primary source of this drag originates from the sliding contact between the cam surface 87 at the distal circumferential end of the plunger head 44 with the underside displacement surfaces 54 of the collet finger members. Briefly, the secondary source of the drag originates from the sliding contact of the pushrod against the interior walls of the maneuvering wand, as well as the flex of the pushrod, during axial displacement between the disengaged and engaged conditions.

One technique to reduce fractional drag between the components is to reduce the surface area contact. As shown in FIG. 11, the longitudinal cross-sectional profile of the cam surface 87 is slightly convex shaped in a smooth and constant curvature. Accordingly, as the plunger cam surface 87 slideably contacts the underside displacement surfaces 54 of the finger members 52, a relative point contact is caused at the longitudinal cross-sectional profile thereof, or collectively, a thin circle contact region (FIGS. 5B and 5C).

Moreover, in accordance with the present invention, the underside displacement surfaces 54 of the finger members 52 are also configured to reduce the drag with the plunger cam surface 87. In a similar manner, the longitudinal cross-sectional profile of the displacement surfaces 54 are slightly convex (FIGS. 5 and 9), each providing a like smooth and constant curvature from the proximal opening 50 to the distal tip portions 55 thereof. Accordingly, the two opposed, constantly curved, convex surfaces slideably contact one another at an even finer circular working region in an effort to reduce drag therebetween.

In another specific embodiment, in addition to the matched curvatures of the plunger head cam surface 87 and the underside displacement surface 54 of the associated finger member 52, the frictional drag therebetween is reduced still further. As viewed in FIGS. 8, 9 and 14, protruding radially inwardly from each underside displacement surface 54 of the associated finger member is at least one upstanding contact rib 92. These radially spaced-apart contact ribs generally extend in a direction longitudinal to the collet device 41, and are bowed or convex-shaped in a profile generally mirroring that of the longitudinal cross-sectional profile of the cam surface 87. In addition, each contact rib is also convex shaped in the transverse cross-sectional dimension (FIG. 14), creating essentially a point-to-point contact of each contact rib 92 and the cam surface 87 of the plunger head 44. In essence, a reduced friction, virtual working surface is generated between the plunger cam surface 87 and the underside displacement surfaces 54.

Figure 14:
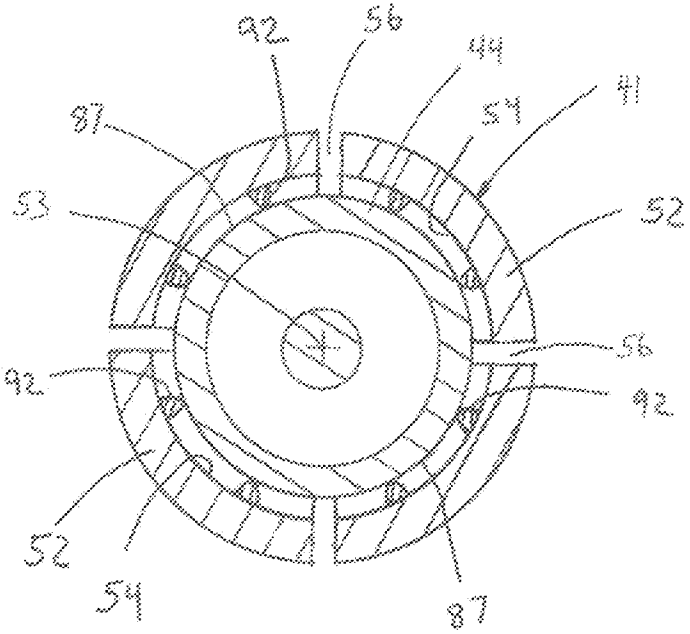
FIG. 14 is an enlarged, rear elevation view, in cross-section, of the sliding engagement between the plunger mechanism and the gripping mechanism of the tool assembly taken substantially along the plane of the line 14-14 of FIG. 5B.

Preferably, two spaced-apart contact ribs 92 are provided for each displacement surface 54 of the corresponding finger members 52. For example, in the four finger members of the collet device 41, there are a total of eight (8) radially spaced-apart upstanding contact ribs 92. FIG. 14 best illustrates, therefore, that there are essentially eight sliding contact points between the collet displacement surfaces 54 and the plunger cam surface 87. It will be appreciated, however, that more or less upstanding contact ribs 92 can be increased or decreased. Generally, a minimum number of contact points is desirable, while providing sufficient stability of the sliding contact.

To even further reduce frictional drag, the coefficient of friction between the collet displacement surfaces 54 and the plunger cam surface 87 is reduced. This may be performed by smoothing those contacting surfaces to remove and eliminate any burring and/or imperfections to provided a uniformly curved and polished surface on each of the upstanding contact ribs 92 and the plunger cam surface 87. Accordingly, the more polished the sliding surfaces, the lower the coefficient of friction therebetween.

Another technique to reduce the coefficient of friction therebetween is through material selection, the inclusion of other friction modifiers, and/or the addition of other friction reducing materials. For example, such low friction materials include nylon, polypropelene, polyethylene, TEFZEL®, TEFLON®materials, and acetal, etc. Friction modifiers may include plastics having additives made of one or more of the following: TEFLON® (PTFE), oils, molybendum disulfide, and graphite.

Finally, the contact angle between the curvature of the plunger cam surface 87 and the curvature of the upstanding contact ribs 92 are matched to eliminate or substantially reduce the wedging effect between the two sliding contact components. With two surfaces in sliding contact with one another, the contact angle determines the wedging action therebetween. By matching the curvature of the underside displacement surfaces 54 of the collet device to the curvature of the plunger cam surface 87, a constant line of contact therebetween can be achieved. In the current embodiment, the plunger head pushes on two raised ribs 92, whose surface intersects a virtual constant curvature along the plunger path. For example, if the collective underside displacement surfaces 54 of the collet device were cone-shaped and the plunger head 44 were sphere-shaped, the curvature of the displacement surface of each collet finger would only match the plunger cam surface at one point along its path. In this example, hence, everywhere else along the path would have point contacts.

Preferably, the contact angle is in the range of about three (3) Degrees per side to about twenty (20) Degrees per side, an more preferably about twelve (12) Degrees per side with the collet device in the gripping position.

The combination of the contact angles between the curvature of the plunger cam surface 87 and the curvature of the upstanding contact ribs 92, and the coefficient of friction therebetween, wedging will be eliminated or substantially reduced between the collet device 41 and the plunger head 44, even when the plunger head is past the threshold displacement portion and in the fully engaged condition. Accordingly, as mentioned, once the user selectively releases operation of the slide switch when fully in the engaged condition (FIG. 5C), although delayed, the opposite biasing force of the biasing spring 88 will return the release device to the normal disengaged condition (FIG. 5A).

An additional advantage of this ribbed configuration is that it provides a self-cleaning function. Since these longitudinally extending contact ribs 92 are upstanding from the corresponding displacement surface 54, any contaminate will tend to migrate between the intermediary space between the contact ribs. This self cleaning feature, accordingly, helps reduce contaminant scoring and retain the highly polished contacting surfaces in their highly polished state for a greater duration.

The sliding frictional contact between, the release pushrod 45 and the interior walls of the maneuvering wand 28 is also reduced. This is especially imperative since the maneuvering wand 28 is slightly curved. Thus, the dynamic interaction of the pushrod 45, as it displaces between the disengaged condition and the engaged condition, is significantly different than if the maneuvering wand were generally straight. That is, since the maneuvering wand 28 is curved, frictional contact between the pushrod 45 and the interior wails 60 of the maneuvering wand 28 will likely occur, increasing collective frictional drag.

To reduce the inherent contact of the pushrod 45 against the interior walls 60 defining the longitudinal wand cavity 32 as the release device reciprocates between the disengaged condition and the engaged condition, the pushrod 45 is configured to have a curvature, in its natural steady state, similar to that of the maneuvering wand 28. This is clearly shown in FIGS. 3 and 10, which illustrates the release device 43 in a longitudinal cross-sectional dimension.

To facilitate centering and support of the pushrod 45 in the wand cavity 32 as the release device 43 reciprocates between the disengaged and the engaged condition, the maneuvering wand includes a plurality of support hearings 93 axially spaced-apart along the longitudinal axis of the wand cavity (FIGS. 3 and 5). Each support bearing 93 is plate-like, and is disposed substantially perpendicular to the longitudinal axis of the maneuvering wand 28. Extending longitudinally through each support bearing is a generally circular aperture defined by a bearing surface 95.

The diameter of the circular aperture is sufficiently large to enable reciprocal passage of the pushrod 45 therethrough. The tolerance between the diameter of the circular aperture and the diameter of the pushrod 45, for instance, is in the range of about 0.003 inch to about 0.050 inch, and more preferably about 0.010 inch per side. In one example, the pushrod diameter is in the range of about 0.050 inch to about 0.375 inch, and more preferably about 0.17 inch, while the diameter of the circular aperture is about 0.19 inch.

As the pushrod axially reciprocates, portions of the exterior surfaces of the pushrod 45 slideably engage the bearing surfaces 95 of the support bearings 93 to center the pushrod 45 and prevent sliding contact with the interior walls 60 defining the wand cavity. As mentioned, this is specifically imperative since the wand cavity is slightly curved. In the specific embodiment illustrated in FIG. 3, six (6) support bearings 93 are axially spaced-apart along the wand cavity 32 in addition to the bearing surface of the distal spring retainer plate 90. The spacing between adjacent support bearings 93 is slightly less in the wand cavity were the bend radius is more pronounced. Just at the region just distal to the sliding switch, bearing structure spacing is smaller than that at the attachment end of the maneuvering wand, since the likelihood of functional contact with the interior walls is increased.

To reduce frictional sliding contact, similar to the plunger cam surface 87 and the finger underside displacement surfaces 54, the bearing surfaces 95 are each convex-shaped in a smooth and constantly curved manner. Thus, FIGS. 5A-5C best illustrate that any sliding contact with the exterior surface of the pushrod 45 with be essentially a point contact with the respective bearing surface 95.

In accordance with the present invention, the pushrod 45 must be sufficiently flexible to negotiate the curvature of the maneuvering wand 28 during reciprocal movement therethrough, yet be sufficiently stiff to open the finger members upon engagement with the plunger head 44. The bending and stiffness properties can be controlled through material selection, thickness of the pushrod, as well as the pushrod design. Generally, however, a stiffness in the range of about 0.06 inch to about 1.0 inch deflection with the slide switch end clamped and about a seven (7) gram weight attached to the plunger tip, and more preferably about 0.17 inch deflection with seven (7) gram weight.

Figure 12:
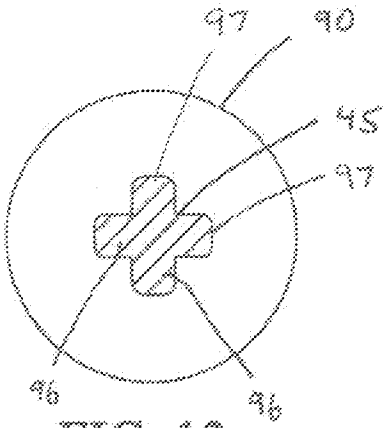
FIG. 12 is an enlarged, rear elevation view, in cross-section, of a pushrod of the release device taken substantially along the plane of the line 12-12 of FIG. 10.

Moreover, in one configuration and as shown in FIG. 12, the transverse cross-sectional dimension of the pushrod is generally cross-shaped. Each cross portion 96 of the pushrod has a height of preferably about 0.17 inch. Further, each cross portion 96 extends substantially the longitudinal length of the pushrod, and terminates radially at a rounded, smoothly curved lobes 97. Accordingly, as the release device 43 is urged between the disengaged condition and the engaged condition, if any sliding contact occurs between the pushrod curved lobes 97 and bearing surfaces 95 of any of the support bearings, the frictional contact will be significantly reduced similar to the techniques applied above. These include matching of the contacting angles between the sliding surfaces, as well as polishing the surfaces to reduce the coefficient of friction therebetween.

Collectively, by applying the design and friction reducing techniques discussed, the drag between the plunger head and the collet device, as well as between the pushrod 45 and the support bearings can be significantly reduced. Accordingly, the tool assembly designed in accordance with the present invention is capable of achieving a sufficiently high holder force on the order of about five (5) lbf to about fifteen (15) lbf., and more preferably about nine (9) lbf to about eleven (11) lbf., while at the same time achieving a consumer friendly release force at the slide switch on the order of about one (1) lbf to about five (5) lbf, and more preferably about one and three-quarters (1¾) lbf. to about three and one-half (3½) lbf.

Although only a few embodiments of the present inventions have been described in detail, it should be understood that the present inventions may be embodied in many other specific forms without departing from the spirit or scope of the inventions.

We claim:

1. A cleaning tool assembly comprising:

A. a removably mounted cleaning implement comprising:

i. a cleaning element comprising a material selected from the group consisting of: polyether and polyurethane;

ii. a fitment, mounted to the cleaning element and extending axially away from the cleaning element along a longitudinal axis thereof;

B. an elongated maneuvering wand comprising:

i. a handle portion;

ii. a distal implement attachment end, said attachment end defining a wand opening into a cavity of said wand;

iii. an expandable gripping device disposed within said cavity, and including a distal gripping portion defining a distal mouth portion formed and dimensioned to receive the fitment, said distal gripping portion expandable between a gripping position, releasably gripping the distal end of the fitment within said wand cavity, and a release position, expanding the mouth portion by an amount sufficient for release of the fitment therefrom;

iv. a release device including a slide switch slideably mounted to the handle portion; and v. a flexible pushrod adapted for movement of the gripping device between the gripping position of the gripping device, and the release position of the gripping device.

2. The cleaning tool assembly according to claim 1, wherein said maneuvering wand includes a gradually curved portion thereof between the handle portion and the attachment end, and said pushrod is substantially similarly curved at a corresponding portion thereof when positioned in the cavity of the maneuvering wand.

3. The cleaning tool assembly according to claim 2, wherein said maneuvering wand includes two or more support bearings positioned along said wand cavity, and cooperating with the pushrod to enable unobstructed axial movement thereof between the gripping position and the release position.

4. The cleaning tool assembly according to claim 3, wherein at least one of said support bearings is plate-shaped, and includes a bearing surface defining a respective aperture enabling reciprocal passage of the pushrod therethrough.

5. The cleaning tool assembly according to claim 4, wherein each bearing surface of said support bearing is concave shaped to reduce frictional contact with the pushrod during movement between the disengaged condition and the engaged condition.

6. The cleaning tool assembly according to claim 1, wherein the gripping device includes a tine portion that engages a retaining barb on the fitment.

7. The cleaning tool assembly according to claim 1, wherein said gripping device includes a proximal base portion defining a proximal opening into a gripping recess thereof, and a plurality of resilient finger members extending distally toward said wand opening, and each said resilient finger member being mounted thereto for movement of a distal tip of the respective finger member between the gripping position and the release position.

8. The cleaning tool assembly according to claim 7, wherein the distal tip portions of the finger members cooperating to define said mouth portion, said finger members further being positioned generally around a longitudinal axis of the gripping device in a manner collectively defining a gripping recess therein formed for receipt of said fitment when in the gripping position.

9. The cleaning tool assembly according to claim 1, wherein the fitment has a pivotal movement along the longitudinal axis thereof, relative to a longitudinal axis of the gripping mechanism, that is between about 0 to 12 degrees.

10. The cleaning tool assembly according to claim 1, wherein the maneuvering wand is comprised of two mirror-image half-shell members which are fastened together.

* * * * *